US006783127B2

(12) United States Patent
Fish

(10) Patent No.: US 6,783,127 B2
(45) Date of Patent: Aug. 31, 2004

(54) CONCENTRIC GAME BOARD AND METHOD OF PLAYING A GAME

(76) Inventor: Jon William Fish, 921 S. Park Rd. #307, Hollywood, FL (US) 33021

( * ) Notice: Subject to any disclaimer, the term of this patent is extended or adjusted under 35 U.S.C. 154(b) by 0 days.

(21) Appl. No.: 10/163,055

(22) Filed: Jun. 5, 2002

(65) Prior Publication Data

US 2003/0227133 A1 Dec. 11, 2003

(51) Int. Cl.[7] ..... A63F 3/00
(52) U.S. Cl. ..... 273/248; 273/287
(58) Field of Search ..... 273/242, 248, 273/258, 260, 261, 262, 255, 287

(56) References Cited

U.S. PATENT DOCUMENTS

| | | | | |
|---|---|---|---|---|
| 611,758 A | | 10/1898 | Murphy | |
| 3,642,280 A | * | 2/1972 | Llorens | 273/108.4 |
| 4,019,740 A | | 4/1977 | Ball et al. | |
| 4,322,085 A | | 3/1982 | Stallard | |
| 4,339,136 A | * | 7/1982 | Gittings | 273/242 |
| 4,385,764 A | * | 5/1983 | Bhatti | 273/243 |
| 4,477,080 A | | 10/1984 | Baker | |
| 4,804,191 A | | 2/1989 | Tankersley | |
| 4,886,279 A | | 12/1989 | Taylor | |
| 4,895,375 A | | 1/1990 | Blitz et al. | |
| 4,915,392 A | | 4/1990 | Swartz | |
| 5,421,582 A | * | 6/1995 | Ritter | 273/261 |
| 5,498,005 A | | 3/1996 | Jacques | |

FOREIGN PATENT DOCUMENTS

| | | | | |
|---|---|---|---|---|
| FR | 2558383 A | * | 7/1985 | A63F/3/08 |
| GB | 2219217 A | * | 12/1989 | A63F/3/00 |
| GB | 2223177 A | * | 4/1990 | A63F/3/00 |
| GB | 2263409 A | * | 7/1993 | A63F/3/00 |
| GB | 2 267 442 A | | 12/1993 | |

* cited by examiner

*Primary Examiner*—Vishu K Mendiratta
(74) *Attorney, Agent, or Firm*—Laurence A. Greenberg; Werner H. Stemer; Gregory L. Mayback

(57) ABSTRACT

A game board includes concentric circular areas (outer, middle, and center) each having a respective subset of piece locations. A barrier separates locations in the outer and middle areas and/or in the middle and center areas. Outer and middle area locations and some center area locations are disposed in a ring. Other center area locations are disposed inside the center ring. The barrier has two to four openings for pieces to pass through. A barrier separating the center and middle areas has at most four openings, preferably two aligned on a single diameter. Outer area locations have at least two different visual identifiers. A game includes providing a playing piece set to players, each set having one special piece and different other pieces identical to one another. Each player takes turns to prevent an opponent's special piece from being able to move without elimination of any piece during the game.

7 Claims, 23 Drawing Sheets

CONCENTRIC GAME BOARD AND METHOD OF PLAYING A GAME

BACKGROUND OF THE INVENTION

Field of the Invention

The invention lies in the field of games. The invention relates to board games in which the pieces belonging to competing players may be moved in a variety of ways so as to win the game. In particular, the invention relates to a concentric game board and method of playing a game. In conventional games, such as checkers, a player becomes bored after many competitive contests. Therefore, there is a need for a new board game that stimulates renewed interest from players because of the novelty of each individual game.

SUMMARY OF THE INVENTION

It is accordingly an object of the invention to provide a concentric game board and method of playing a game that overcome the hereinafore-mentioned disadvantages of the heretofore-known devices and methods of this general type and that provides a uniquely shaped and compact game board, engenders renewed player interest, requires a relatively high degree of skill to master, and does not seek to remove opponent's pieces from the game board during play. With the foregoing and other objects in view, there is provided, in accordance with the invention, a game board, including at least three concentric circular areas each having piece placement locations for receiving playing pieces thereupon, the areas including an outer area, a middle area, and a center area, the outer area having a first subset of the piece placement locations disposed in a ring, at least one location of the first subset being a first gate location, the middle area having a second subset of the piece placement locations disposed in a ring, at least one location of the second subset being a second gate location, the center area having a third subset of the piece placement locations disposed in a ring, at least one location of the third subset being a third gate location, and a fourth subset of the piece placement locations disposed inside the third subset, a first barrier separating the first subset from the second subset, the first barrier having at least one first opening adjacent the first gate location defining a first gate path from the outer area to the middle area, a second barrier separating the second subset from the third subset, the second barrier having at most four second openings, one of the second openings adjacent the second gate location defining a second gate path from the middle area to the center area, and the first gate location, the second gate location, the third gate location, the at least one first opening, the one second opening, the first gate path, and the second gate path being aligned along a single diameter of the areas.

In accordance with another feature of the invention, the at least three concentric circular areas are only three areas including the outer area, the middle area, and the center area.

In accordance with a further feature of the invention, the first subset has thirty-two piece placement locations, the second subset has twenty piece placement locations, the third subset has fourteen piece placement locations, and the fourth subset has eight piece placement locations. In particular, the piece placement locations of the fourth subset are disposed in at least one T-shaped path.

In accordance with an added feature of the invention, only two piece placement locations of the first subset are first gate locations, only two piece placement locations of the second subset are second gate locations, only two piece placement locations of the third subset are third gate locations, the first barrier has only two first openings each adjacent one of the first gate locations defining two first gate paths from the outer area to the middle area, and the second barrier has only two second openings each adjacent one of the second gate locations defining two second gate paths from the middle area to the center area.

In accordance with an additional feature of the invention, the two first gate locations, the two second gate locations, the two third gate locations, the two first openings, the two second openings, the two first gate paths, and the two second gate paths are aligned along a single diameter of the areas.

In accordance with yet another feature of the invention, the piece placement locations of the first subset have at least first and second different visual identifiers, at least a majority of the piece placement locations of the first subset are indicated with the first identifier, at least one of the piece placement locations of the first subset is indicated with the second identifier, and the piece placement location with the second identifier is disposed on a second diameter of the areas different from the single diameter.

In accordance with yet a further feature of the invention, the single diameter and the second diameter are orthogonal to one another.

With the objects of the invention in view, there is also provided a game board, including at least three concentric circular areas each having piece placement locations for receiving playing pieces thereupon, the areas including an outer area, a middle area, and a center area, the outer area having a first subset of the piece placement locations, the middle area having a second subset of the piece placement locations, the center area having a third subset of the piece placement locations, and a barrier separating one of the first subset from the second subset and the second subset from the third subset, the barrier having only two openings for pieces to pass through.

In accordance with yet an added feature of the invention, the piece placement locations of the first subset are disposed in a ring and the piece placement locations of the second subset are disposed in a ring.

In accordance with yet an additional feature of the invention, the barrier is a first barrier separating the first subset from the second subset, a second barrier separates the second subset from the third subset, and the second barrier has only two second openings.

In accordance with again another feature of the invention, the two first openings and the two second openings are aligned along a single diameter of the areas.

In accordance with again a further feature of the invention, the third subset has an outer subset and an inner subset of the piece placement locations and the piece placement locations of the inner subset are disposed inside the piece placement locations of the outer subset. Preferably, the inner subset has eight piece placement locations and the piece placement locations of the inner subset are disposed in at least one T-shaped path.

In accordance with again an added feature of the invention, the piece placement locations of the first subset have at least first and second different visual identifiers, at least a majority of the piece placement locations of the first subset are indicated with the first identifier, and at least one of the piece placement locations of the first subset is indicated with the second identifier. Preferably, two of the piece placement locations of the first subset are indicated with the second identifier.

In accordance with again an additional feature of the invention, the two openings of the harrier are disposed on a first diameter of the areas and the piece placement location with the second identifier is disposed on a second diameter of the areas different from the first diameter.

In accordance with still another feature of the invention, the barrier has only three openings for pieces to pass through.

In accordance with still a further feature of the invention, the barrier has only four openings for pieces to pass through.

With the objects of the invention in view, there is also provided a game board, including at least three concentric circular areas each having piece placement locations for receiving playing pieces thereupon, the areas including an outer area, a middle area, and a center area, the outer area having a first subset of the piece placement locations, the middle area having a second subset of the piece placement locations, the center area having a third subset of the piece placement locations, a barrier separating one of the first subset from the second subset and the second subset from the third subset, and the piece placement locations of the first subset having at least first and second different visual identifiers. Preferably, the first subset has thirty-two piece placement locations, the second subset has twenty piece placement locations, and the third subset has twenty-two piece placement locations.

In accordance with still an added feature of the invention, at least a majority of the piece placement locations of the first subset are indicated with the first identifier and at least two of the piece placement locations of the first subset are indicated with the second identifier.

In accordance with still an additional feature of the invention, two of the piece placement locations of the first subset are indicated with the second identifier and two others of the piece placement locations of the first subset are indicated with a third identifier.

In accordance with another feature of the invention, the piece placement locations of the first subset are disposed in a ring and the piece placement locations of the second subset are disposed in a ring.

In accordance with a further feature of the invention, the barrier is a first barrier separating the first subset from the second subset and a second barrier separates the second subset from the third subset.

In accordance with an added feature of the invention, two of the piece placement locations of the first subset are indicated with the second identifier, two others of the piece placement locations of the first subset are indicated with a third identifier, the first barrier has only two first openings, and the second barrier has only two second openings.

In accordance with an additional feature of the invention, the two first openings, the two second openings, and the two piece placement locations of the first subset with the third identifier are aligned along a single diameter of the areas.

In accordance with yet another feature of the invention, at least a majority of the piece placement locations of the first subset are indicated with the first identifier and the two piece placement locations with the second identifier are disposed on a second diameter of the areas different from the single diameter.

In accordance with yet a further feature of the invention, the third subset has an outer subset and an inner subset of the piece placement locations and the piece placement locations of the inner subset are disposed inside the piece placement locations of the outer subset. Preferably, the inner subset has eight piece placement locations and some of the eight piece placement locations of the inner subset are disposed in at Least one T-shaped path.

With the objects of the invention in view, there is also provided a game board consisting of three concentric circular area each having piece placement locations for receiving playing pieces thereupon, the areas including an outer area, a middle area, and a center area, the outer area having a first subset of the piece placement locations disposed in a ring, the middle area having a second subset of the piece placement locations disposed in a ring, the center area having a third subset of the piece placement locations, some of the piece placement locations of the third subset disposed in a ring, a first barrier separating the first subset from the second subset, the first barrier having two first openings, a second barrier separating the second subset from the third subset, the second barrier having two second openings, and the two first openings and the two second openings being aligned along a single diameter of the areas.

With the objects of the invention in view, there is also provided a method of playing game including the steps of providing a game board having a game surface with defined playing piece locations, providing a set of playing pieces to at least two opposing players, each playing piece set having only one first piece and a subset of second pieces identical to one another and different from the first piece, placing each of the playing piece sets on the piece locations of the game surface, and each of the players taking turns to move their own playing pieces among the piece locations and prevent the first piece of another one of the players from being able to move from one of the piece locations to another of the piece locations. Preferably, none of the playing pieces are eliminated throughout the game. In other words, a total number of playing pieces on the game surface is kept constant throughout the entire game.

In accordance with yet an added mode of the invention, the second piece subset is initially defined as having a first set of characteristics, at least two of the piece locations are defined as converting locations, and respective pieces of the second piece subset are defined as having a second set of characteristics when the respective pieces are placed on or jump over one of the converting locations.

In accordance with yet an additional mode of the invention, the second set of characteristics includes characteristics different from and/or in addition to characteristics of the first set of characteristics.

In accordance with a concomitant mode of the invention, the playing piece locations of the game surface are organized in concentric circles.

Other features that are considered as characteristic for the invention are set forth in the appended claims.

Although the invention is illustrated and described herein as embodied in a concentric game board and method of playing a game, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

In the figures of the drawings, unless stated otherwise, identical reference symbols denote identical parts.

Figure 1:
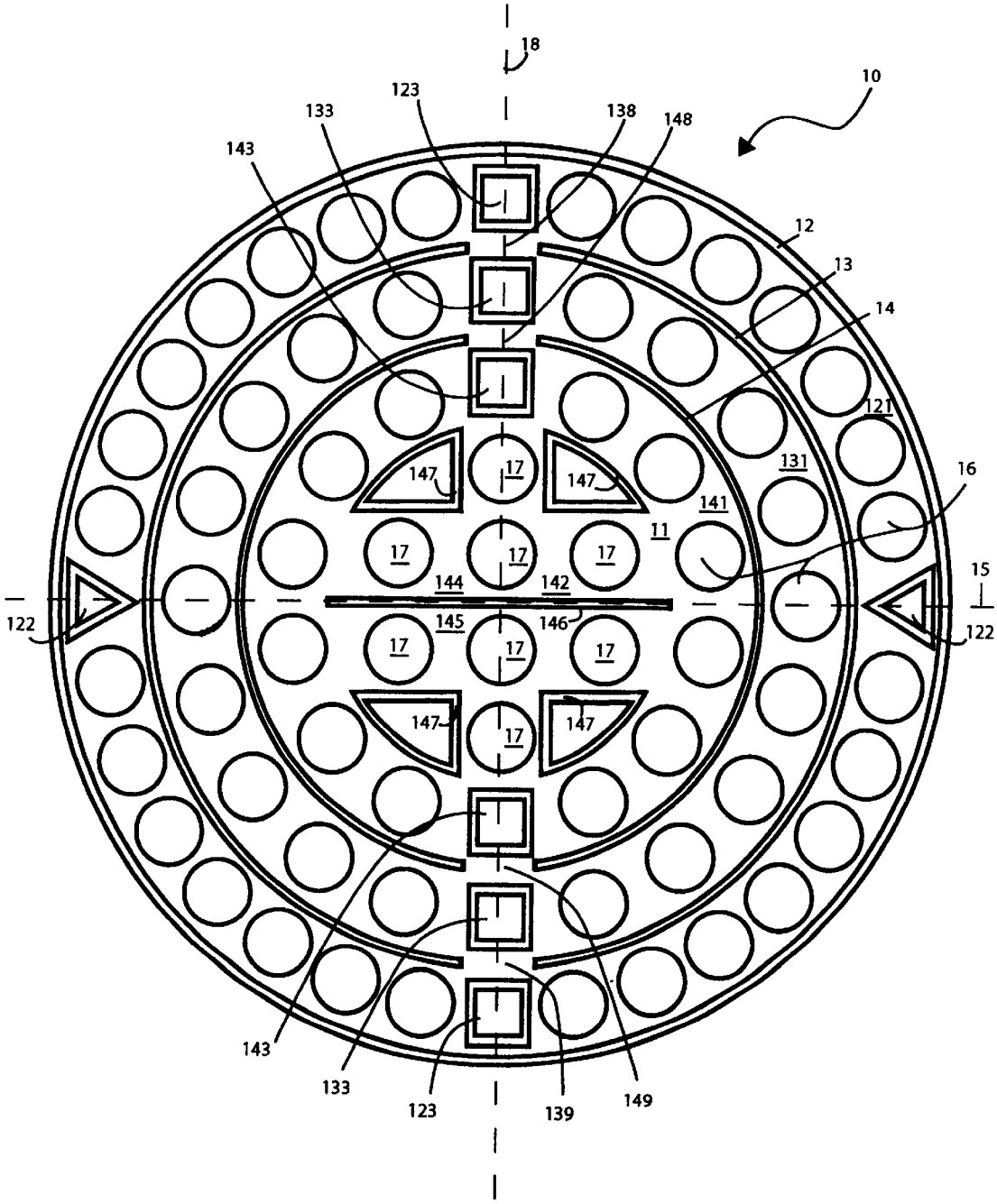
FIG. 1 is a plan view of a game board according to the invention.

Referring now to the figures of the drawings in detail and first, particularly to FIG. 1 thereof, there is shown a first embodiment of a flat game board 10 with a playing surface 11. In the preferred embodiment, the playing surface 11 is configured for play with two players. The playing surface, additionally, can be configured for 3, 4, or more players. See FIGS. 4 and 5.

Figure 2A:
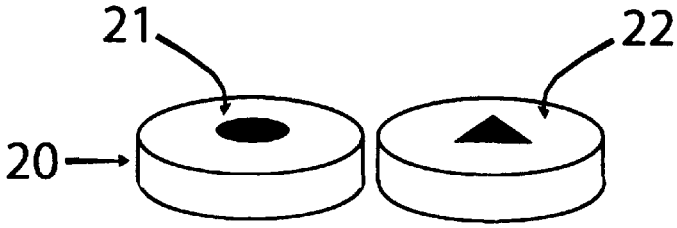
FIG. 2*a* is diagrammatic, perspective view of a game piece according to the invention.
Figure 2B:
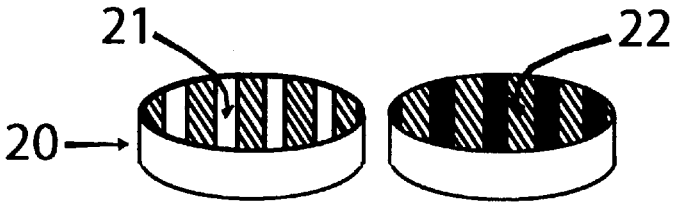
FIG. 2*b* is diagrammatic, perspective view of an alternative embodiment of the game piece of FIG. 2*a;*
Figure 2C:
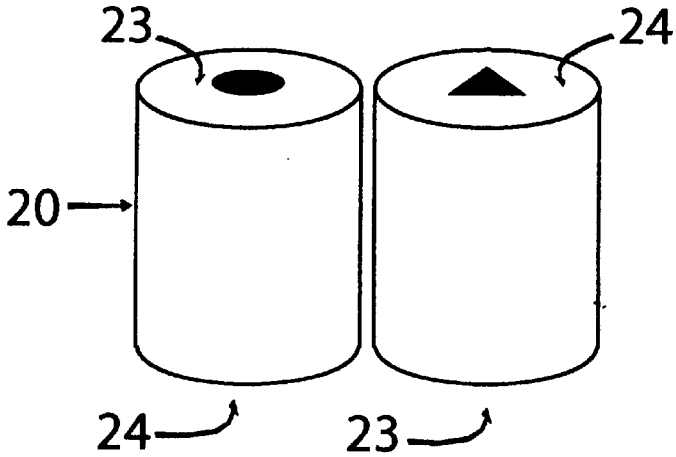
FIG. 2*c* is diagrammatic, perspective view of another alternative embodiment of the game piece of FIG. 2*a;*

Pieces 20 are placed upon the board and move on the playing surface 11 according to a given set of rules, which are described in detail below. The pieces 20 can have various shapes, they can be disks 20 (FIGS. 2A and 2B) each of a given color or shape with different indicia on each side 21, 22, for example, a color other than the given color or a printed, embossed, or raised pictorial. Alternatively, the pieces 20 can be towers 20 (FIG. 2C) each of a given color or shape and each having two ends 23, 24. Each of the two ends 23, 24 can have a color other than the given color or a printed, embossed, or raised pictorial. For example, one side 21, 23 can have a circle and another side 22, 24 can have a triangle. Alternatively, one player's pieces can be red with one white patterned side 21, 23 and one black patterned side 22, 24 and another player's pieces can be white with one red patterned side 21, 23 and one black patterned side 22, 24. Many other permutations of shape, size, and color are possible for the pieces 20.

An outer circle 12 defines an extremity of the playing surface 11. Preferably, the outer circle 12 is unbroken.

Figure 4:
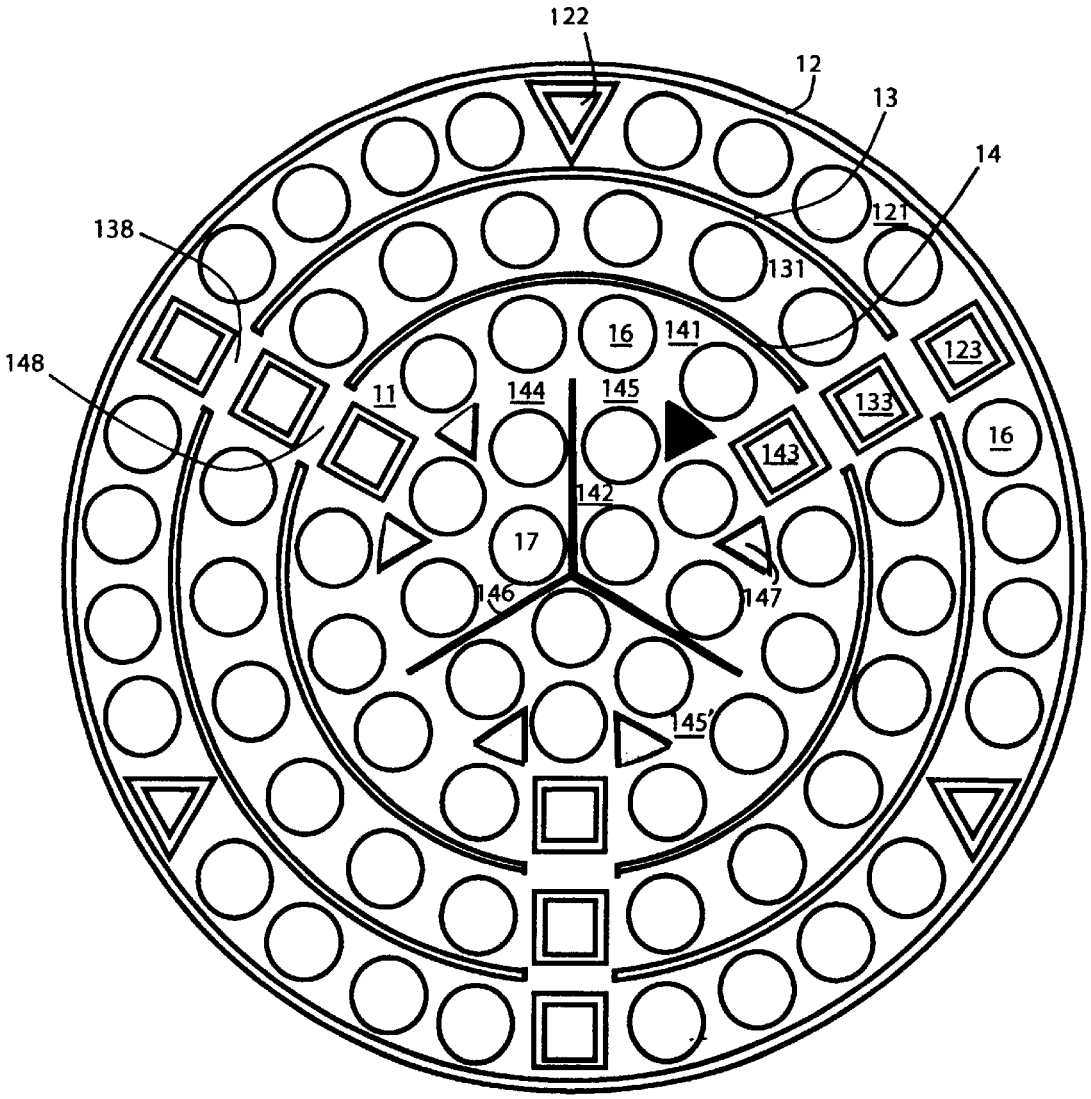
FIG. 4 is a plan view of an alternative embodiment of the game board of FIG. 1 for three players.
Figure 5:
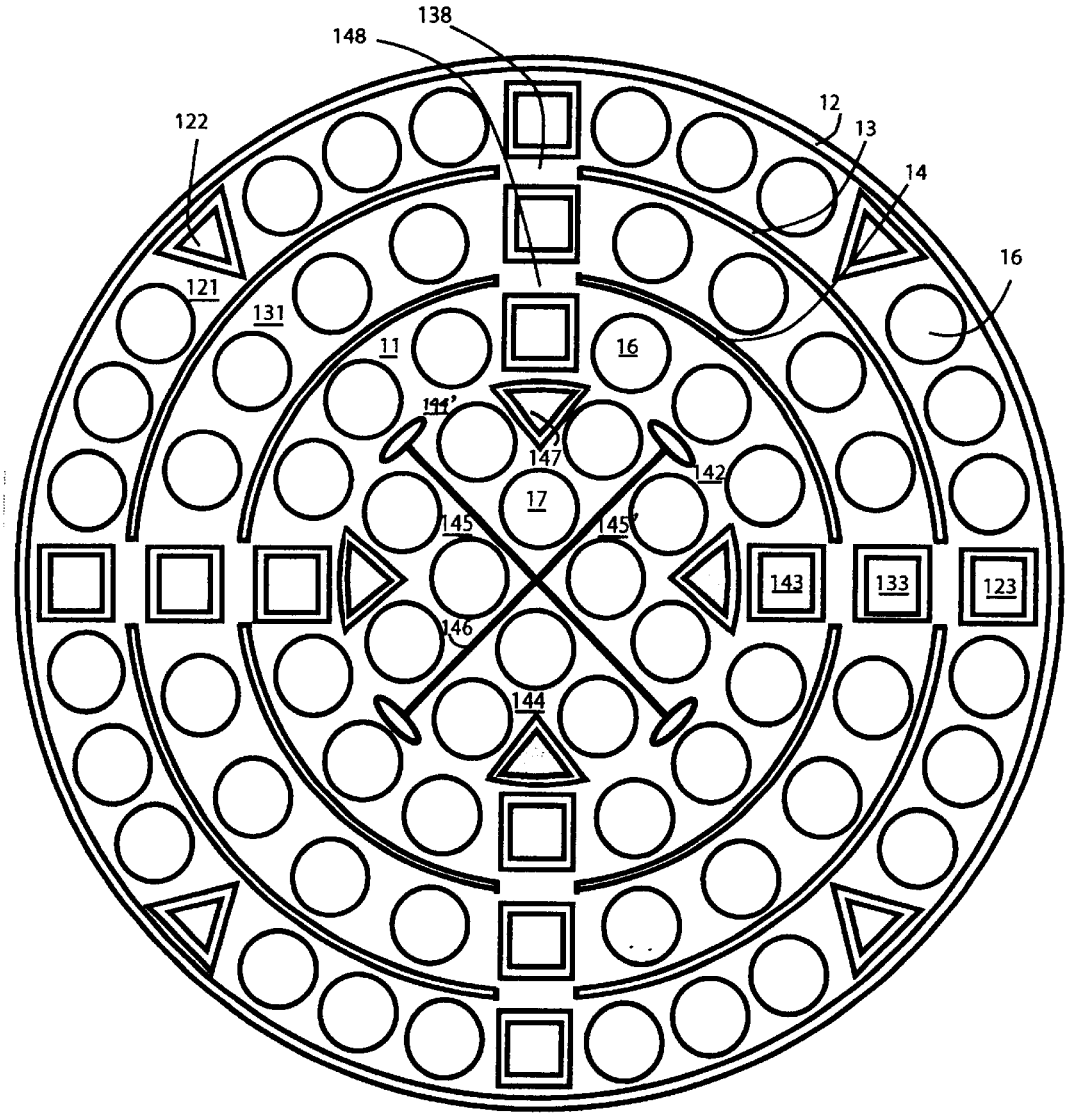
FIG. 5 is a plan view of an alternative embodiment of the game board of FIG. 1 for four players.

Disposed within the outer circle 12 is a middle circle 13. The middle circle 13 is not continuous and, in the preferred embodiment, has two openings 138, 139. The middle circle 13 can have a larger number of openings. For example, in the case of a 3-person embodiment of the playing surface 11, the middle circle 13 has 3 openings (FIG. 4). Similarly, in a 4-person embodiment of the playing surface 11, the middle circle 13 has 4 openings (FIG. 5), and so on.

Disposed within the middle circle 13 is an inner circle 14. The inner circle 14 is not continuous and, in the preferred embodiment, has two openings 148, 149. The inner circle 14 can have a larger number of openings. For example, in the case of the 3-person embodiment of the playing surface 11, the inner circle 14 has 3 openings (FIG. 4). Similarly, in the 4-person embodiment of the playing surface 11, the inner circle 14 could have 4 openings (FIG. 5), and so on.

The outer, middle, and inner circles 12, 13, 14 are concentric, with the inner circle 14 inside the middle and outer circles 13, 12, and the middle circle 13 inside the outer circle 12. The concentric configuration is preferred because such a shape continuously forces the players against or towards one another. Simply put, the further a first player tries to retreat a piece from second player's piece, the closer the first player's piece moves towards the second player's piece.

The circles 12, 13, 14 are preferably printed upon the board 10. However, the circles 12, 13, 14 can also project above the playing surface 11 to form grooves or semi-enclosed three-dimensional areas. Also, the middle circle 13 is spaced inside and from the outer circle 12 at a given radial distance and the inner circle 14 is spaced inside and from the middle circle 13 at the same given radial distance.

The outer circle 12 and the middle circle 13 define a circular outer path 121 therebetween. The outer path 121 has four special spaces 122, 123 equally spaced apart from one another. Two of the special spaces are knighting spaces 122 and two of the special spaces are gates 123. The knighting spaces 122 are disposed on the outer path 121 at positions opposite one another along a first diameter 15 of the concentric circles 12, 13, 14. The gates 123 are disposed on the outer path 121 at positions opposite one another along a second diameter 18 of the concentric circles 12, 13, 14. The gates 123 are also disposed adjacent one of the openings 138 in the middle circle 13. Thus, the openings 138 are also disposed on the second diameter 18. The first and second diameters 15, 18 are orthogonal to one another and, together, divide the playing surface 11 into two or four parts.

In the case of the 3-person embodiment of the playing surface 11, the outer path 121 has 6 special spaces 122, 123 equally spaced apart from one another. Three of the special spaces are knighting spaces 122 and three of the special spaces are gates 123. The knighting spaces 122 are symmetrically disposed on the outer path 121, i.e., at positions 120° with respect to one another. Similarly, the gates 123 are symmetrically disposed on the outer path 121, i.e., at positions 120° with respect to one another. In the outer path 121, each gate 123 is displaced or offset from each adjacent knighting space 122 by 60°. The gates 123 are also respectively disposed adjacent one of three openings 138 in the middle circle 13. Thus, the openings 138 and the gates 123 are disposed on the same three diameters as the gates 133.

In the case of the 4-person embodiment of the playing surface 11, the outer path 121 has 8 special spaces 122, 123 equally spaced apart from one another. Four of the special spaces are knighting spaces 122 and four of the special spaces are gates 123 The knighting spaces 122 are symmetrically disposed on the outer path 121, i.e., at positions 90° with respect to one another. Similarly, the gates 123 are symmetrically disposed on the outer path 121, i.e., at positions 90° with respect to one another. In the outer path 121, each gate 123 is displaced or offset from each adjacent knighting space 122 by 45°. The gates 123 are also respectively disposed adjacent one of four openings 138 in the middle circle 13. Thus, the openings 138 and the gates 123 are disposed on the same two diameters as the gates 133.

Also disposed on the outer path 121 are generic spaces 16, each labeled using a simple circle. The number of spaces 16 in the outer path 121 between each knighting space 122 and gate 123 is equal. There is a number of spaces 16 in the outer path 121 between each knighting space 122 and gate 123. Preferably, for the 2-person embodiment, there is an odd number of spaces 16, in particular, seven spaces 16, in the outer path 121 between each knighting space 122 and gate 123. Of course, the number of spaces 16 between each knighting space 122 and gate 123 can be changed. And, in the case of the 3-person or 4-person embodiment, the number of spaces 16 between each knighting space 122 and gate 123 is different. Preferably, the 3-person embodiment has four spaces 16 between each knighting space 122 and gate 123 and the 4-person embodiment has three spaces 16 between each knighting space 122 and gate 123.

Each of the different spaces 122, 123, 16 is a location on the playing surface 11 at which the pieces 20 can be placed. The knighting spaces 122 are labeled using a triangle to distinguish the knighting space 122 from other spaces 123, 16. Similarly, the gates 123 are labeled using a square to distinguish the gates 123 from other spaces 122, 16. Of course, the spaces 122, 123, 16 each can be indicated with different shapes, indicia, or colors.

The middle circle 13 and the inner circle 14 define a circular middle path 131 therebetween. In the 2-person embodiment, the middle path 131 only has two special spaces 133 spaced apart from one another. These two special spaces are gates 133. The gates 133 are disposed on the middle path 131 at positions opposite one another along the second diameter 16 of the concentric circles 12, 13, 14. As such, each of the gates 133 are disposed adjacent one of the openings 138 in the middle circle 13. Each of the gates 133 are also disposed adjacent one of the openings 148 in the inner circle 14. Thus, the openings 138 in the middle circle 13 and the openings 148 in the inner circle 14 are aligned on the second diameter 18, and the gates 133 are aligned with the gates 123 on the second diameter 18.

In the case of the 3-person embodiment, the middle circle 13 and the inner circle 14 define a circular middle path 131 therebetween. The middle path 131 only has three special spaces 133 spaced apart from one another. These three special spaces are gates 133. Preferably, the gates 133 are disposed on the middle path 131 at positions 120° with respect to one another. As such, each of the gates 133 are disposed adjacent one of three openings 138 in the middle circle 13. Each of the gates 133 are also disposed adjacent one of three openings 148 in the inner circle 14. Thus, the gates 123, the gates 133, the openings 138 in the middle circle 13, and the openings 148 in the inner circle 14 are all respectively aligned on three diameters.

In the case of the 4-person embodiment, the middle circle 13 and the inner circle 14 define a circular middle path 131 therebetween. The middle path 131 only has four special spaces 133 spaced apart from one another. These four special spaces are gates 133. Preferably, the gates 133 are disposed on the middle path 131 at positions 90° with respect one another. As such, each of the gates 133 are disposed adjacent one of four openings 138 in the middle circle 13. Each of the gates 133 are also disposed adjacent one of four openings 148 in the inner circle 14. Thus, the gates 123, the gates 133, the openings 138 in the middle circle 13, and the openings 148 in the inner circle 14 are all respectively aligned on two diameters.

Spaces 16 are also disposed on the middle path 131. The number of spaces 16 in the middle path 131 between each gate 133 is equal. Preferably, in a 2-person embodiment, there are an odd number of spaces 16 in the middle path 131 between each gate 133, in particular, there are nine spaces 16 in the middle path 131 between each gate 133. Of course, the number of spaces 16 between each gate 133 can be changed. For example, in the case of the 3-person embodiment, the middle path 131 has six spaces 16 between each gate. In the 4-person embodiment, the middle path 131 has four spaces 16 between each gate, and so on. Of course, the number of spaces 16 between each gate 133 in each of the 3- or 4-person embodiments can be changed.

The inner circle 14 has an interior 142 and similarly defines a circular inner path 141 in the interior 142. Like the middle path 131, the inner path 141 in the 2-person embodiment only has two special spaces 143 spaced apart from one another. These two special spaces are gates 143. The gates 143 are disposed on the inner path 141 at positions opposite one another along the second diameter 18 of the concentric circles 12, 13, 14. Thus, each of the gates 143 is disposed adjacent one of the openings 148 in the inner circle 14. Such a configuration, therefore, aligns the gates 143 with the gates 133 and with the gates 123 on the second diameter 18.

In the case of the 3-person embodiment, the inner circle 14 has an interior 142 and similarly defines a circular inner path 141 in the interior 142. Like the middle path 131, the inner path 141 only has three special spaces 143 spaced apart from one another. These three special spaces are gates 143. The gates 143 are disposed on the inner path 141 at positions 120° with respect to one another. Thus, each of the gates 143 is disposed adjacent one of three openings 148 in the inner circle 14. Such a configuration, therefore, aligns the gates 143 with the gates 133 and with the gates 123.

In the case of the 4-person embodiment, the inner circle 14 has an interior 142 and similarly defines a circular inner path 141 in the interior 142. Like the middle path 131, the inner path 141 only has four special spaces 143 spaced apart from one another. These four special spaces are gates 143. The gates 143 are disposed on the inner path 141 at positions 90° with respect to one another. Thus, each of the gates 143 is disposed adjacent one of four openings 148 in the inner circle 14. Such a configuration, therefore, aligns the gates 143 with the gates 133 and with the gates 123.

Spaces 16 are also disposed on the inner path 141. The number of spaces 16 in the inner path 141 between each gate 143 is equal. Preferably, in the 2-person embodiment, there is an even number of spaces 16 in the inner path 141 between each gate 143. In particular, there are six spaces 16 in the inner path 141 between each gate 143. Of course, the number of spaces 16 between each gate 143 can be changed. A reason why the number of spaces in the inner path 141 between each gate 143 is an even number is so that the interior 142 can be divided into two sections 144, 145, preferably hemispheres. As described below, these sections 144, 145 define the starting areas for each of the players' pieces 20.

In the case of the 3-person embodiment, the spaces 16 are also disposed on the inner path 141. The number of spaces 16 in the inner path 141 between each gate 143 is equal. Preferably, there is a total number of spaces 16 in the inner path 141, that total being divisible by 3. In particular, there are four spaces 16 in the inner path 141 between each gate 143. Of course, the number of spaces 16 between each gate 143 can be changed. A reason why the number of spaces in the inner path 141 is a multiple of three is so that the interior 142 can be divided into three sections 144, 145, 145', preferably, 3 equal-sized divisions. As described below, these sections 144, 145, 145' define the starting areas for each of the players' pieces 20.

In the case of the 4-person embodiment the spaces 16 are also disposed on the inner path 141. The number of spaces 16 in the inner path 141 between each gate 143 is equal. Preferably, there is a total number of spaces 16 in the inner path 141, that total being divisible by 4. In particular, there are three spaces 16 in the inner path 141 between each gate 143. Of course, the number of spaces 16 between each gate 143 can be changed. A reason why the number of spaces in the inner path 141 is a number that is divisible by 4 is so that the interior 142 can be divided into four sections 144, 144', 145, 145', preferably, 4 equal-sized divisions. As described below, these sections 144, 144', 145, 145' define the starting areas for each of the players' pieces 20.

A center wall or barrier 146 divides the sections 144, 144', 145, 145'. In the 2-person embodiment, the center wall 146 is positioned along the first diameter 15 starting from a center point of the circles 12, 13, 14 and extending along the first diameter 15 in either direction. However, the center wall 146 does not extend all the way to the inner circle 14. It stops at a distance from the inner circle 14 that is equal to the radial spacing between the outer and middle walls 12, 13 and the radial spacing between the middle and inner walls 13, 14. Such a shape allows the inner path 141 to be circular around the entire inner side of the inner circle 14 without interruption.

In the case of the 3-person embodiment, a center wall or barrier 146 divides the three sections 144, 145, 145'. The center wall 146 is positioned along three equilateral radii starting from a center point of the circles 12, 13, 14 and extending along these three radii in each direction. However, the center wall 146 does not extend all the way to the inner circle 14. It stops at a distance from the inner circle 14 that is equal to the radial spacing between the outer and middle walls 12, 13 and the radial spacing between the middle and inner walls 13, 14. Such a shape allows the inner path 141 to be circular around the entire inner side of the inner circle 14 without interruption.

In the case of the 4-person embodiment, a center wall or barrier 146 divides the four sections 144, 144', 145, 145'. The center wall 146 is positioned along two diameters starting from a center point of the circles 12, 13, 14 and extending along each diameter in both directions thereof. However, the center wall 146 does not extend all the way to the inner circle 14. It stops at a distance from the inner circle 14 that is equal to the radial spacing between the outer and middle walls 12, 13 and the radial spacing between the middle and inner walls 13, 14. Such a shape allows the inner path 141 to be circular around the entire inner side of the inner circle 14 without interruption.

The interior 142 also contains center spaces 17 disposed inside the spaces 16 along the inner path 141. The center spaces 17 are the same as the spaces 16 and, therefore, any description of spaces 16 applies to spaces 17 as well, but spaces 17 are given a different reference numeral for the sake of clarity. The number of center spaces 17 in each section 144, 144', 145, 145' is equal. Preferably, in the 2- and 3-person embodiments, there are four center spaces 17 in each section 144, 145, 145'. of course the number of center spaces 17 in each section 144, 144', 145, 145' can be changed, especially for 3- and 4-person playing surfaces 11. Some of the center spaces 17 of each section 144, 145 are disposed along diameters, the second diameter 18 in the 2-person embodiment. Some of the center spaces 17 of each section 144, 145 in the 2-person embodiment are disposed, or are also disposed, along a line that is parallel to the first diameter 15 and that passes through the center points of two spaces 16 along the inner path 141 closest to the first diameter 15.

In the case of the 3-person embodiment, the interior 142 also contains center spaces 17 disposed inside the spaces 16 along the inner path 141. As above, the center spaces 17 are the same as the spaces 16 and, therefore, any description of spaces 16 applies to spaces 17 as well. The number of center spaces 17 in each section 144, 145, 145' is equal. Preferably, there are four center spaces 17 in each of three sections 144, 145, 145'. Of course the number of center spaces 17 in each section 144, 145, 145' can be changed. Some of the center spaces 17 of each section 144, 145, 145' are disposed along a given one of three radii. Some of the center spaces 17 of each section 144, 145 are disposed, or are also disposed, along a line that is at an angle to a particular radius.

In the case of the 4-person embodiment, the interior 142 also contains center spaces 17 disposed inside the spaces 16 along the inner path 141. As above, the center spaces 17 are the same as the spaces 16 and, therefore, any description of spaces 16 applies to spaces 17 as well. The number of center spaces 17 in each section 144, 144', 145, 145' is equal. Preferably, there are three center spaces 17 in each section 144, 144', 145, 145'. Of course, the number of center spaces 17 in each section 144, 144', 145, 145' can be changed. Some of the center spaces 17 of each section 144, 144', 145, 145' are disposed along the same diameters as the gates 123, 133, 143. Some of the center spaces 17 of each section 144, 144', 145, 145' are disposed, or are also disposed, along a lines that are at an angle to these diameters.

In the case of the 2-person embodiment, to keep movement of pieces 20 linear, preferably four spacing walls 147 are disposed in the interior 142. An exterior of the spacing walls 147 defines portions of a circle that surround all of the center spaces 17. The spacing walls 147 preferably delineate areas of the playing surface 11 at which pieces 20 are not placed or are not moved.

In the case of the 3-person embodiment, to keep movement of pieces 20 linear, preferably, six spacing walls 147 are disposed in the interior 142. An exterior of the spacing walls 147 defines portions of a circle that surround all of the center spaces 17. The spacing walls 147 preferably delineate areas of the playing surface 11 at which pieces 20 are not placed or are not moved.

In the case of the 4-person embodiment to keep movement of pieces 20 linear, preferably, four spacing walls 147 are disposed in the interior 142. An exterior of the spacing walls 147 defines portions of a circle that surround all of the center spaces 17. The spacing walls 147 preferably delineate areas of the playing surface 11 at which pieces 20 are not placed or are not moved.

Like the inner, middle, and outer circles 14, 13, 12, both the center wall 146 and the spacing walls 147 are printed on the playing surface 11. However, these walls 146, 147, too, may project above the playing surface 11 to form grooves, semi-enclosed, or enclosed three-dimensional areas. While all spaces 16, 17, 122, 123, 133, 143 are preferably printed on the playing surface 11, they also may project above the playing surface to form tower-like projections for holding one piece 20. In such a configuration, the projection can be a tower with a concave roof for holding a spherical piece 20, like a marble, for example.

Setting up the Game

Figure 3:
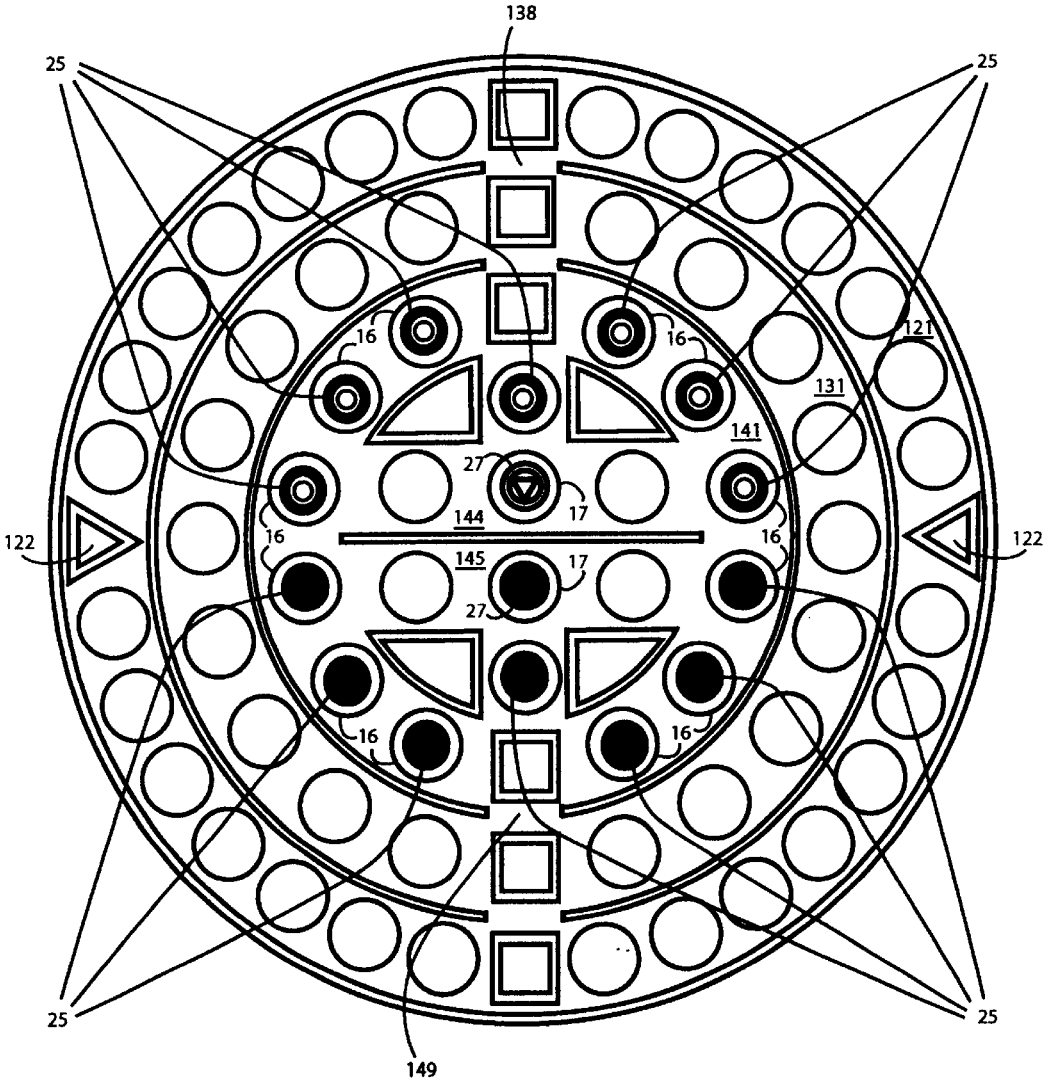
FIG. 3 is a plan view of the game board of FIG. 1 illustrating the initial starting positions of two opponents' pieces.

In the 2-person embodiment, there are two players, each having eight pieces 20. Of the eight pieces 20, each player has seven Squires 25 and one Royal 27. To begin, each player places the respective seven Squires 25 on the spaces 16 indicated in the interior 142 in one section 144, 145 as illustrated in FIG. 3. Each player also places the respective Royal 27 into a central space 17 (preferably the center-most central space 17) as also shown in FIG. 3. The explanation below is directed to the 2-person embodiment, however, all of the text equally applies to the 3- and 4-person embodiments.

Objective of the Game

The objective of the game is to prevent one player from being able to move their Royal 27. Each player first moves his or her own Squires 25 to the outer path 121 and converts all of the Squires 25 to Knights 26 by passing over the knighting space 122. The Knights 26 are then used to attack an opponent's Royal 27. The attack is deemed successful and the game is over if one player's Royal 27 is no longer able to move to another space 16, 17, 122, 123, 133, 143.

Rules of Play

In the embodiments shown in the drawings, the game according to the invention should be played according to the following rules.

One slayer begins by moving a piece 25, 27 according to the rules of piece movement that follow. Opposing players alternate turns, a turn being defined in the section below titled "A Player's Turn." Failure to move during a player's turn results in a forfeit of the game.

In the preferred embodiment, two people play against each other. However, more than two people can play as two teams, with turns proceeding in any fashion. In the 3- and 4-person embodiments, there are three and four players or teams, respectively.

Piece Movement

Squire

Squires 25 cannot move on their own. In other words, their movement is dependent upon another piece. Squires 25 can only move by jumping another piece 26, 27 or in conjunction with the Royal 27 in a Pivot Move, which is described in further detail below and is associated with movement of the Royal 27. One Squire 25 of one player may jump any number of that player's pieces 25, 26, 27 provided that they are linear and there is an empty space 16, 17, 122, 123, 133, 143 to receive the Squire 25 at the end of the jump. In this case, linear means that the pieces are adjacent one another in any form of line with no open spaces 16, 17, 122, 123, 133, 143 in between. A "jump", as it is referred to herein, is a movement of one or more pieces 25, 26, 27 along a path from a space 16, 17, 22, 123, 133, 143 next to another piece or pieces 25, 26, 27 over those piece or pieces 25, 26, 27, to an open space or spaces on the other side of the piece or pieces 25, 26, 27 being jumped. Examples of various moves are demonstrated in FIGS. 4A to 18*b*.

One Squire 25 of one player may jump any number of the other player's pieces 25, 26, 27 as long as they are linear and there, is a space 16, 17, 122, 123, 133, 143 to receive the Squire 25 at the end of the jump. There is one exception, however, one Squire 25 of one player may not jump over another player's piece or pieces 25, 26, 26 if it will cause him to pass through a gate. See the gate rules below for further explanation.

In order to approach the knighting space 122, each Squire 25 must first exit the opposing side of each ring 14, 13. This procedure is explained with respect to FIG. 3. For a Squire 25 of the white team (player starting in section 144) to go from the inner path 141 to the middle path 131, each white Squire 25 must first exit opening 149. Likewise, for a Squire 25 of the white team to go from the middle path 131 to the outer path 141, each white Squire 25 must then exit opening 138. The opposite is true for the black team (player starting in section 145). Such movement, therefore, forces each player's pieces 25, 27 towards the other player's pieces 25, 27.

When a Squire 25 completes a movement over a knighting space 122—meaning that the Squire 25 moves from a first space 16 on one side of the knighting space 122 to the knighting space 122 or to a second different space 16 on another side of the same knighting space 122 (by jumping other pieces (25, 26, 27)—that Squire 25 become a Knight 26.

More than one adjacent Squire 25 of one player may jump over any combination of the opponents Royal, Knights or Squires, provided that there is sufficient space to receive all of the jumping Squires 25 and provided that the jumping Squires 26 can overpower the pieces being jumped. Overpowering means that the value of the pieces of the first player performing the jump is greater than the value of the piece(s) of the other player to be jumped. Thus, two Squires 25 can overpower one opposing Squire 25; three Squires 25 can overpower two opposing Squires 25. When jumping the opponent's Royal 27 or when jumping the opponents Royal 27 in connection with other pieces 25, 26 of the opponent's pieces, the Royal 27 counts as two in the overpower calculation. Thus, three Squires 25 of one player can jump over the other player's Royal 27, and four Squires 25 of one player can jump over a combination of another player's Royal 27 and one Squire 25 in a space adjacent the space occupied by the Royal 27 being jumped.

Multiple Squires 25 of one player cannot jump over one or more Squires 25 or Knights 26 of that same player. In other words, more than one Squire 25 of one player can never jump over one or more of that player's other pieces 25, 26, 27. Simply put, Squires 25 of one player may jump only individually over one or more of that same player's pieces 25, 26, 27—provided there is sufficient space for the single jumping Squire 25 to land when it completes the jump.

Any single piece 25, 26, 27 of one player can jump over any combination of different pieces 25, 26, 27 of another player, except a Royal 27 cannot jump over a Knight 26. However, no single piece 25, 26, 27 of one player can jump over a set of pieces including one or more pieces 25, 26, 27 of that same player and one or more pieces 25, 26, 27 of another player. This means that a single Squire 25 of one player can jump over any number and/or combination of the other player's Squires 25, Knights 26, and/or Royal 27.

At no time can a piece 25, 26, 27 jump an empty space.

Knighting Squires

A Squire 25 becomes a Knight 26 by passing over either knighting space 122 in path 121.

A Squire(s) 25 can become a Knight(s) 26 by pivoting about the Royal 27 (see the description of the pivot move below) and moving from one side of the knighting space 122 to the knighting space 122 or to the other side thereof.

Multiple Squires 25 can become Knights 26 by jumping over an opponent's piece(s) if the jump causes the Squires 25 to pass to or over the knighting space 122 in the jumping process. This is only true if the jumping Squires 25 can overpower the opponent's pieces.

A Squire(s) 25 of one player can become a Knight(s) by jumping over another Squire(s) 25 of that same player if the jump causes the jumping Squire(s) to pass to or over the knighting space 122 in the jumping process.

Knight

Knights 26 may move independently one space at a time. Knights 26 may also move in conjunction with other pieces 25, 27. Knights 26 may also move in conjunction with a Royal 27 in a pivot move, which is explained in detail below and is associated with movement of the Royal 27.

One Knight 26 of one player may jump any number of Knights 26 of the same player provided that they are linear and there is an empty space 16, 17, 122, 123, 133, 143 to receive the Knight at the end of the jump.

One Knight 26 of one player may jump any number of the other player's pieces 25, 26, 27 as long as the pieces 25, 26, 27 to be jumped are linear or connected and there is a space 16, 17, 122, 123, 133, 143 to receive the Knight at the end of the jump There is one exception, however, one Knight 26 of one player may not jump over another player's piece or pieces 25, 26, 27 if it will cause the first player's Knight 26 to pass through a gate. See the gate rules below for further explanation.

Knights may enter and exit any gate 123, 133, 143 provided they are in compliance with the gate rules set forth below.

Multiple Knights 26 of one player may only jump over multiple numbers of the other player's pieces 25, 26, 27, provided that there are sufficient spaces 16, 17, 122, 123, 133, 143 to receive the jumping pieces and provided the jumping Knights 26 can overpower the pieces being jumped. Thus, two Knights 26 of one player can overpower one of the other player's Knights 26, three Knights 26 of one player can overpower two of the other player's Knights 26, three Knights 26 of one player can overpower two of the other player's squires 25, etc. When one player's Knights 26 are jumping the other player's Royal 27, or are jumping the other player's Royal 27 in connection with other pieces of the other player, the Royal 27 counts as two in the overpower calculation.

Multiple Knights 26 of one player cannot jump over one or more of that same player's Squires 25 or Knights 26.

Any single piece 25, 26, 27 of one player can jump over any combination of different pieces 25, 26, 27 of another player, except a Royal 27 cannot jump over a Knight 26. Also, no single piece 25, 26, 27 of one player can jump over a set of pieces including one or more pieces 25, 26, 27 of that same player and one or more pieces 25, 26, 27 of another player. This means that a single Knight 25 of one player can jump over any number and/or combination of the other player's Squires 25, Knights 26, and/or Royal 27.

At no time can a piece 25, 26, 27 jump an empty space.

Royal

A Royal 27 may move independently one space 16, 17, 122, 123, 133, 143 at a time or in conjunction with other pieces 25, 26.

A Royal 27 of one player may jump any number of that same player's other pieces 25, 26 provided that the pieces 25, 26 to be jumped are linear and provided there is an empty space 16, 17, 122, 123, 133, 143 to receive the jumping Royal 27 at the end of the jump.

A Royal 27 of one player may jump any number of another player's Squires 25 as long as the Squires 25 to be jumped are linear and provided there is an empty space 16, 17, 122, 123, 133, 143 to receive the jumping Royal 27 at the end of the jump.

A Royal 27 of one player may jump over another player's Royal 27 provided there is an empty space 16, 17, 122, 123, 133, 143 to receive the jumping Royal 27 at the end of the jump.

A Royal 27 of one player may not, under any circumstances, jump over another player's Knight(s) 26.

A Royal 27 may enter and exit any gate 123, 133, 143 provided the Royal 27 is in compliance with the rules relating to gates 123, 133, 143 and provided that the movement will not require the Royal 27 to pass over an opponent's Knight(s) 26.

However, a Royal 27 has restricted movement with respect to the inner circle 14. Once a Royal 27 exits the inner circle 14 once, that Royal 27 will be trapped in the inner circle 14 if that Royal 27 returns to the inner circle 14 by passing through either one of the openings 148, 149 from the middle path 131. In other words, if a Royal 27 reenters the inner circle 14 at any time after first leaving the inner circle 14, that Royal 27 cannot exit through openings 148, 149 again.

With respect to an overpower calculation for a jump of an opponent's piece or pieces, the Royal 27 has a value of two. Thus, one Royal 27 plus one Squire 25 or Knight 26 of one player may jump over two of the other player's Squires 25. A Royal 27 and two Squires 25 or Knights 26 may jump over three of the other player's Squires 25, but a Royal 27 of one player may never jump over another player's Knight(s) 26.

When jumping multiple pieces 25, 26, 27 of one player over multiple pieces 25, 27 of another player, if the pieces being jumped include the other player's Royal 27, that Royal 27 has a value of two.

Any single piece 25, 26, 27 of one player can jump over any combination of different pieces 25, 26, 27 of another player, except a Royal 27 cannot jump over a Knight 26. This means that a Royal 27 of one player can jump over any number and/or combination of the other player's Squires 25 and/or Royal 27. But, no single piece 25, 26, 27 of one player can jump over a set of pieces including one or more pieces 25, 26, 27 of that same player and one or more pieces 25, 26, 27 of another player.

At no time can a piece 25, 26, 27 jump an empty space.

The Pivot Move

The Royal 27 is a necessary requirement to perform a pivot move.

A Royal 27 of one player may be used to convey any number of Squires 25 and/or Knights 26 of that same player through the pivot move. The pivot move is performed by moving one or more Squires 25 and/or Knights 26 of one player around the Royal 27 of the same player to one or more respective empty spaces 16, 17, 122, 123, 133, 143 on another side of the Royal 27.

Because the Royal 27 does not move in a pivot move, the other moving pieces 25, 26 are referred to as "pivoting" around the non-moving Royal 27.

Pivoting is not jumping. Therefore, with respect to a direction radiating outward from the Royal 27 used for the pivot, all pieces 25, 26 pivoted must be placed in the new empty spaces 16, 17, 122, 123, 133, 143 in the same consecutive order as they were in before the pivot. The piece or group of pieces 25, 26 involved in the pivot move may land on any consecutive or connecting empty spaces 16, 17, 122, 123, 133, 143. There is one exception, however. The pieces 25, 26 pivoting may not pivot out a gate 123, 133, 143 unless the Royal 27 is already in the gate 123, 133, 143. In other words, if a Royal 27 being used to pivot other pieces 25, 26 is not already in a gate 123, 133, 143, pivoting will move the pieces 25, 26 past the gate 123, 133, 143 but not through it. See the rules relating to the gates 123, 133, 143 in the next section.

Gates

There are three sets of gate pairs, two gates 143 in the inner path 141, two gates 133 in the middle path 131, and two gates 123 in the outer path 121. The two inner gates 143 lead from the inner path 141 to the middle path 131. The two middle gates 133 lead to both the inner path 141 and to the outer path 121. The two outer gates 123 lead from the outer path 121 to the middle path 131.

A gate 123, 133, 143 may only be exited or entered if there is a piece 25, 26, 27 on the gate 123, 133, 143 to jump.

A single game piece 25, 26, 26 may rot move from one gate to an empty adjacent gate. Simply put, a piece 25, 26, 27 cannot move from an inner gate 143 to the middle gate 133, or from the outer gate 123 to the middle gate 133, or from the middle gate 133 to either the outer gate 123 or the inner gate 143 unless that moving piece is jumping a piece present in the gate 123, 133, 143.

When encountering an opponent's piece(s) in a gate 123, 133, 143, a player must overpower the opponent's piece(s) to exit and there must be sufficient empty spaces 16, 17, 122, 123, 133, 143 on the other side of the gate 123, 133, 143 to accept the first player's pieces 25, 26, 27.

A Squire 25 of one player may exit through a gate 123, 133, 143 only one at a time, but only if one or more of that same player's pieces is occupying the gate 123, 133, 143. What is meant by the phrase "occupying the gate" is that a player can have a subset of adjacent pieces with one of such pieces being on the gate 123, 133, 143. The number of pieces 25, 26, 27 in a gate 123, 133, 143 is determined by the number of the same player's sequential pieces 25, 26, 27 radiating outward from the piece 25, 26, 27 occupying the gate 123, 133, 143. It is possible to have different numbers of pieces 25, 26, 27 protecting different routes to the same gate 123, 133, 143. When attacking a gate 123, 133, 143, one player must overpower the pieces 25, 26, 27 that are in the route to the gate 123, 133, 143, while always bearing in mind that a Royal 27 of one player may never jump over another player's Knight(s) 26.

Any two or more Squires 25 or Knights 26 of one player can exit a gate 123, 133, 143 that is occupied by another player's piece 25, 26, 27 (or pieces if the other player's pieces are adjacent that player's piece occupying a gate 123, 133, 143) only if the first player can overpower the other player's piece(s) to be jumped. As set forth above, Squires 25 and Knights 26 have a value of one and the Royal 27 has a value of two in the overpower calculation.

A Royal 27 of one player may exit or enter a gate by jumping over one or more of that player's own pieces 25, 26.

Alone, a Royal 27 of one player cannot jump more than one of the other player's Squires 25 to get out of a gate because the Royal 27 does not overpower the other player's piece(s). Squires 25, before becoming Knights 26, can only exit or enter through opposing, successive gates 123, 133, 143 as set forth in the description related to Squires 25 and with respect to FIG. 3.

A Knight 26 of one player may exit or enter any gate 123, 133, 143 in another path 121, 131, 141 only if that Knight 26 is jumping one or more of the same player's pieces in the gate 123, 133, 143 within the path 121, 131, 141 from which the Knight 26 is jumping. Knights 26 of one player may also exit or enter any gate 123, 133, 143 occupied by the other player's pieces(s) provided that the jumping Knights 26 overpower the other player's piece(s) to be jumped.

If a Royal 27 of one player is in the gate 133 of the middle path 131, the Knights 26 of that same player may be used in a Pivot Move to exit and enter all three paths 121, 131, 141, but only if there is sufficient spaces 16, 17, 122 to receive the pivoting Knights 26.

If any piece 25, 26, 27 is in the gate 133 of the middle path 131, that piece 25, 26, 27 may be used to access any path 121, 131, 141 so long as the rules of overpowering a piece 25, 26, 27 in the gate 133 are observed. The only exception is that a Royal 27 may not pass over an opponent's Knight(s) 26.

If a row of Squires 25 and/or Knights 26 in a first path 121, 131, 141 connect, by becoming adjacent, to a row of the same player's Squires 25 and/or Knights 25 outside that first path 121, 131, 141, the connecting Squires 25 and/or Knights 26 may be used together in a Pivot Move, and any piece 25, 26, 27 of that player may traverse that row in and out of the gate 123, 133, 143 by jumping over the other same player's pieces 25, 26, 27.

A Player's Turn

Each player must make a move during a turn. If one player cannot make a move, the game for that player is over and, if no other players remain, the last remaining player wins the game.

Every time one player jumps one or more of another player's piece(s) 25, 26, 27, that player must make another move. This means that a player's turn cannot end until that player either jumps one of his or her own piece(s) 25, 26, 27 or moves one of his or her own pieces 25, 26, 27 within the acceptable rules of play without jumping the opponent's piece(s) 25, 26, 27.

Rules of Attack

The Royal 27 is considered as being under attack if there is no immediate space 16, 17, 122, 123, 133, 143 to which the Royal 27 can move.

If a Royal 27 is under attack, that player must defend the Royal 27 by creating a space 16, 17, 122, 123, 133, 143 for the Royal 27 to move. If such a space 16, 17, 122, 123, 133, 143 cannot be created, the game is over and that player loses the game.

A player cannot place his or her own Royal 27 under attack. If such a move is the only move available to that player, then the game is over and that player loses the game.

Rules of Capture

If a player cannot move his or her own Royal 27 or demonstrate an ability to move his or her own Royal 27 in that player's turn, the game is over and that player loses the game.

If a player cannot make a space 16, 17, 122, 123, 133, 143 for his or her own Royal 27 to move or cannot move his or her own Royal 27 out of attack in that player's turn, the game is over and that player loses the game.

There are various ways to capture in a 3- or 4-person embodiment of the game. One version can include a rule that a player who has a Royal 27 trapped by another player is out of play and must stop taking turns of play. That trapped player's pieces 25, 26, 27 remain on the playing surface 11. If, during continued playing of the game by the other players, the trapped player is no longer trapped, that player is back in play and continues taking turns as before. Such a rule provides a unique twist to the game and has a pronounced effect on strategy and duration of play. Alternatively, another version of the game can include a rule that a player who has a Royal 27 trapped by another play is out of the game and takes all pieces off the playing surface 11. Play continues for all remaining other players.

Examples of Various Possible Moves

The following text describes various possibilities for moving pieces 20 in the game. For the sake of clarity, every one of the spaces 16, 17, 122, 123, 133, 143 has been given a unique number or letter.

Figure 6A:
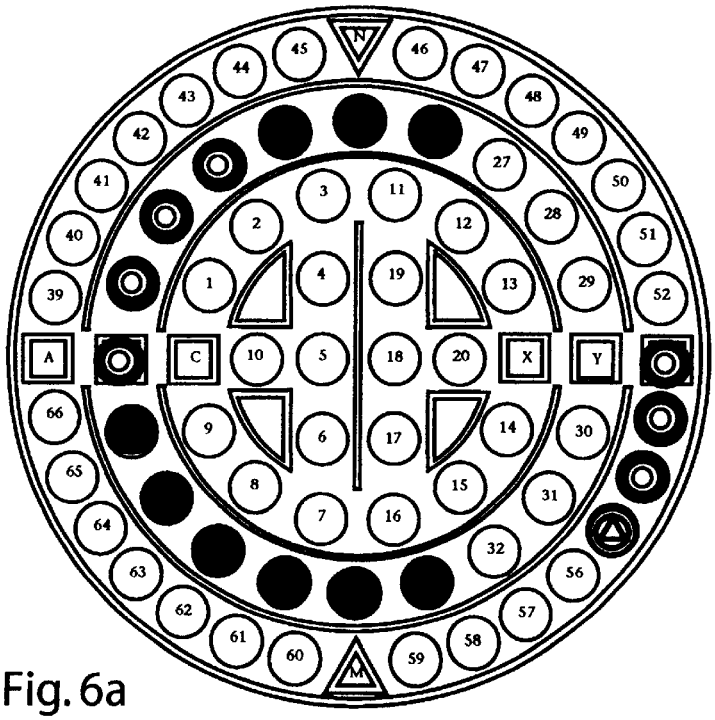
FIGS. 6*a* and 6*b* are plan views of the game board of FIG. 1 illustrating a jump of multiple pieces.
Figure 6B:
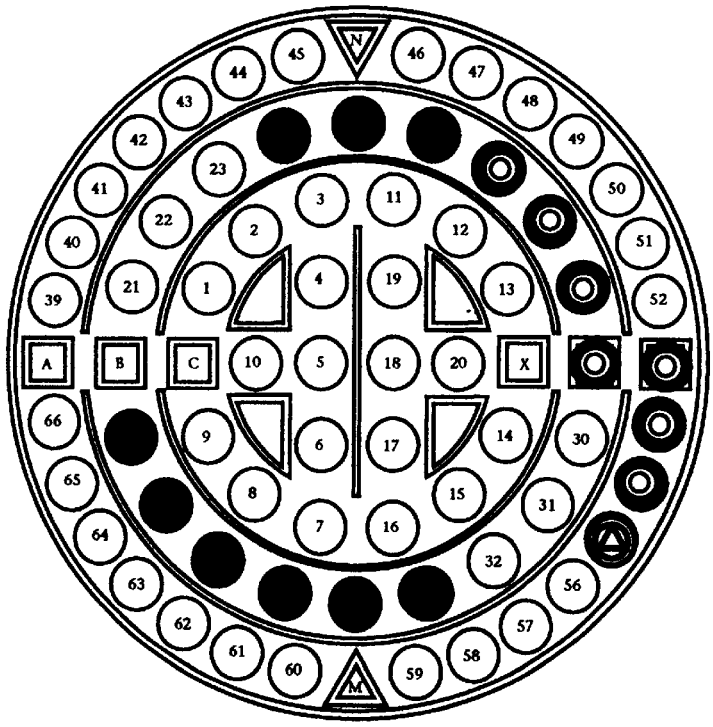

FIGS. 6*a* and 6*b* illustrate an example of jumping multiple pieces.

FIG. 6*a* shows a white player preparing to move Squires 25, located in positions B (which is a gate 133), 21, 22, and 23, to overpower and jump multiple pieces of the gray player in positions 24, 25, and 26.

FIG. 6*b* shows the white player's Squires 25 having landed in open positions 27, 28, 29, and Y (which is a gate 133). Because the white player has jumped another player's pieces, the white player is required to take another turn. Significantly, the white player is now linear (the first set of Squires 25 are connected to three other Squires 25 and the Royal 28 in positions Z, 53, 54, and 55, respectively. The white player is now in a position to use the pivot move to take all of its seven Squires 25 to the outer ring 121. Such a move would place the Squires 25 in positions 56, 57, 58, 59, M (which is a knighting space 122), 60, and 61. Because the two squires 25 in positions M, 60, and 61 have crossed over or landed on the knighting space M (122, they would be converted to Knights 26.

Figure 7A:
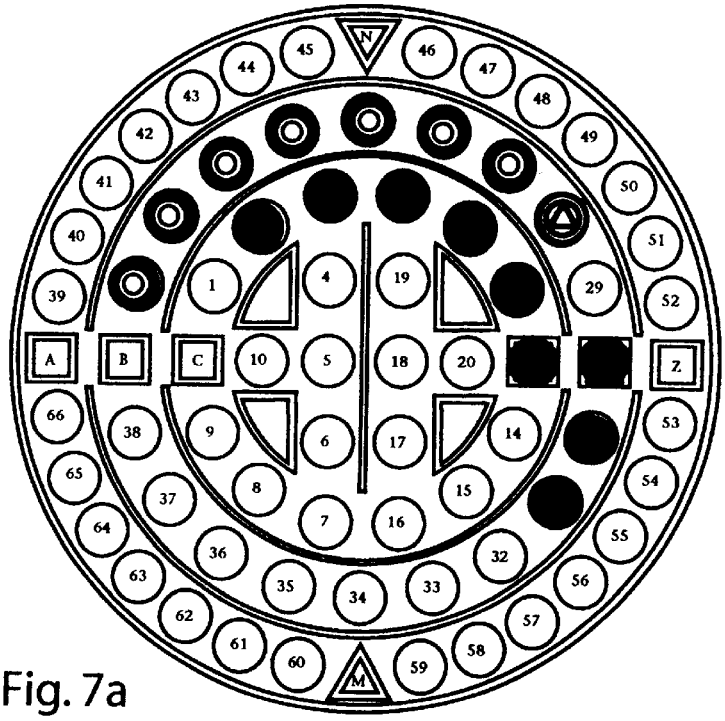
FIGS. 7*a* and 7*b* are plan views of the game board of FIG. 1 illustrating a pivot move.
Figure 7B:
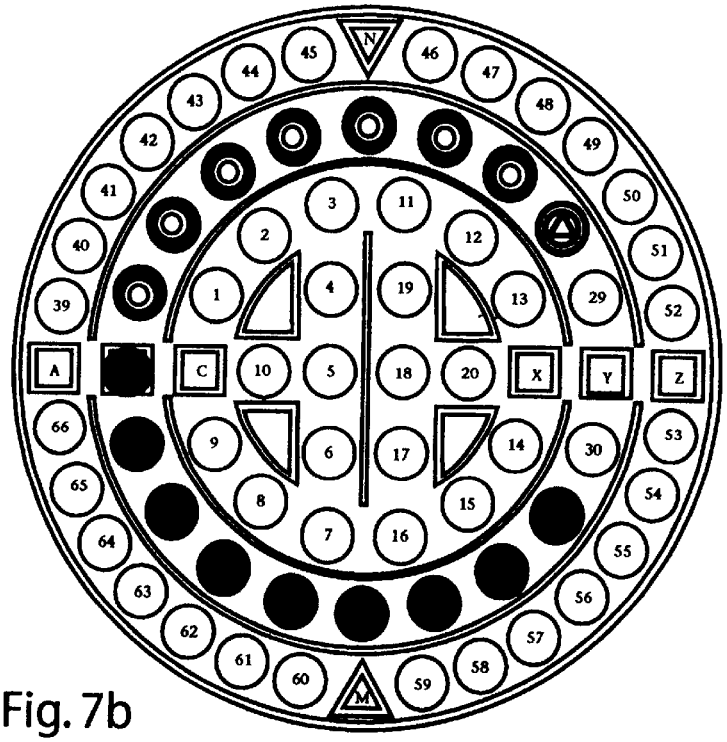

FIGS. 7*a* and 7*b* illustrate an example of a pivot move.

In FIG. 7*a*, the gray player is preparing to pivot Squires 25 in positions 30, Y, X, 13, 12, 11, 3, and 2 around the gray Royal 27 in position 31.

In FIG. 7*b*, the gray Squires 26 have landed in positions 32, 33, 34, 35, 36, 37, 38, and B. It is noted that the gray Royal 27 does not change its position 31 during the pivot move.

Figure 8A:
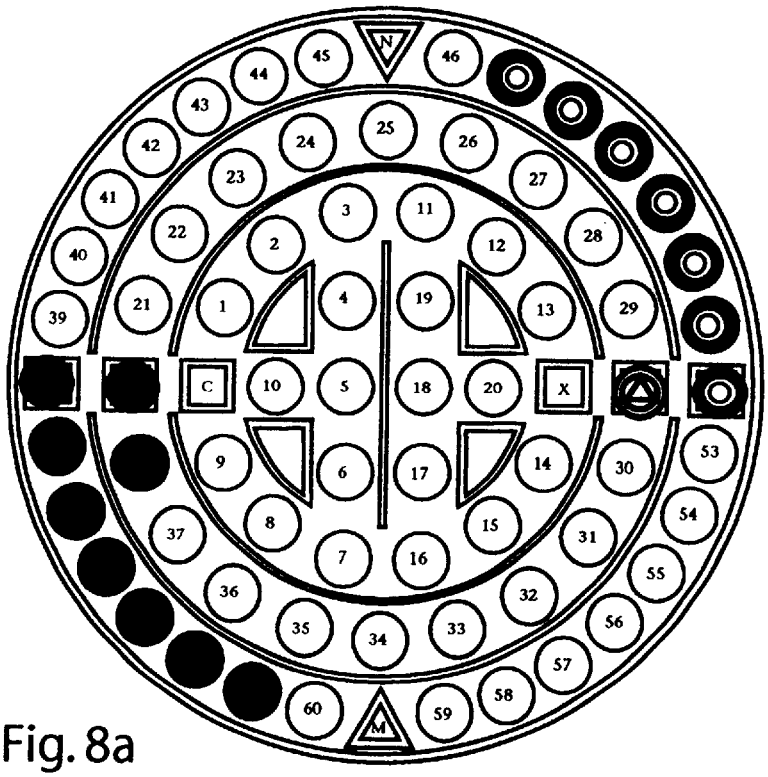
FIGS. 8*a* and 8*b* are plan views of the game board of FIG. 1 illustrating knighting of squire pieces.
Figure 8B:
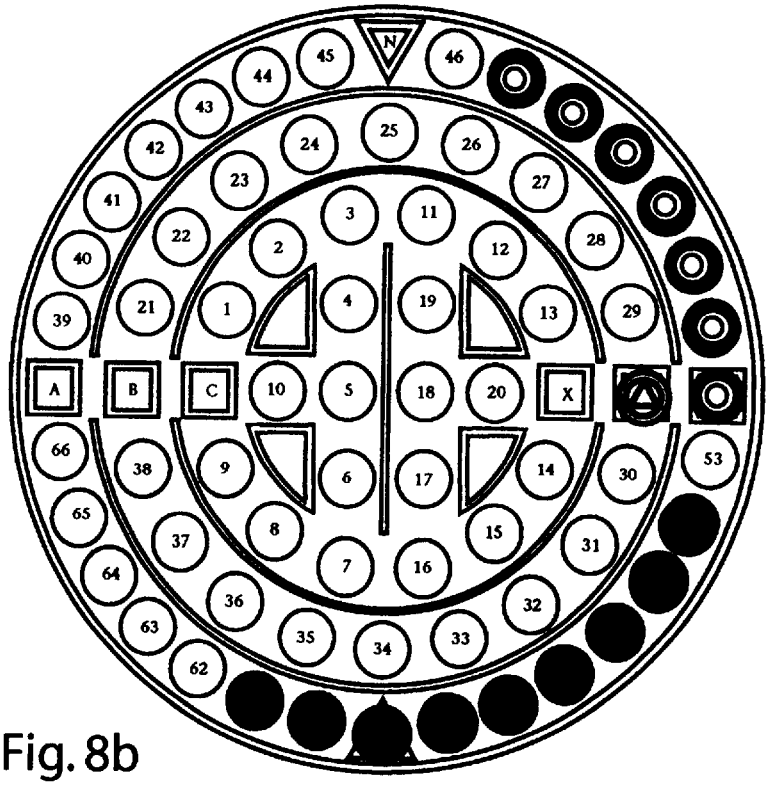

FIGS. 8*a* and 8*b* illustrate an example of knighting Squires 25.

In FIG. 8*a*, the gray player is preparing to pivot its Squires 25 in positions 38, B, A, 66, 65, 64, 63, and 62, around the gray Royal 27 in position 61.

In FIG. 8*b*, the gray Squires 25 have landed in open positions 60, M, 59, 58, 57, 56, 55, and 54. Because gray Squires 25 in positions M, 59, 58, 57, 56, 55, and 54 have passed over or have landed on the knighting space M, they are converted to Knights 26, indicated by the interior triangle instead of the interior circle. It is noted that the gray Squire 25 in position 60 does not convert to a Knight 26 in this turn.

Figure 9A:
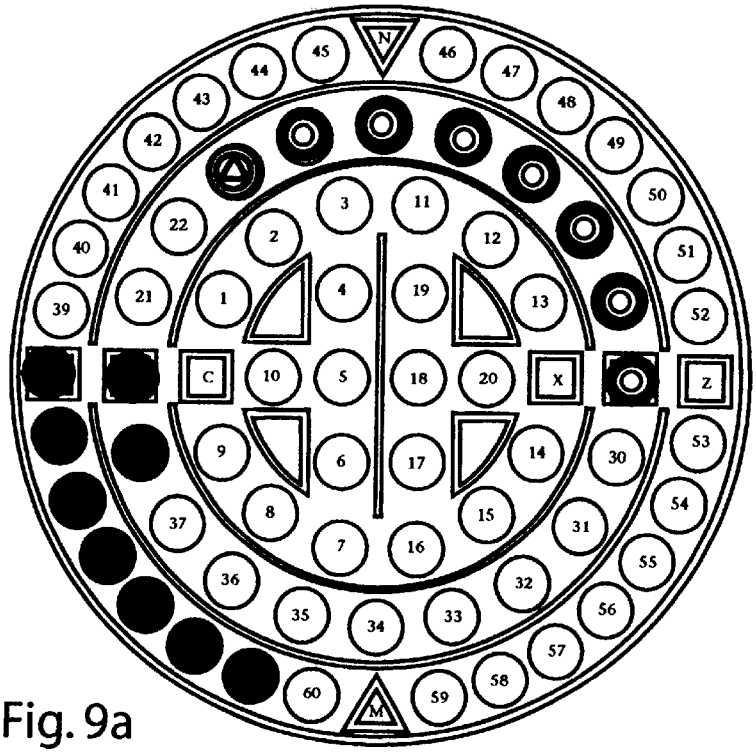
FIGS. 9*a* and 9*b* are plan views of the game board of FIG. 1 illustrating piece movement through gates.
Figure 9B:
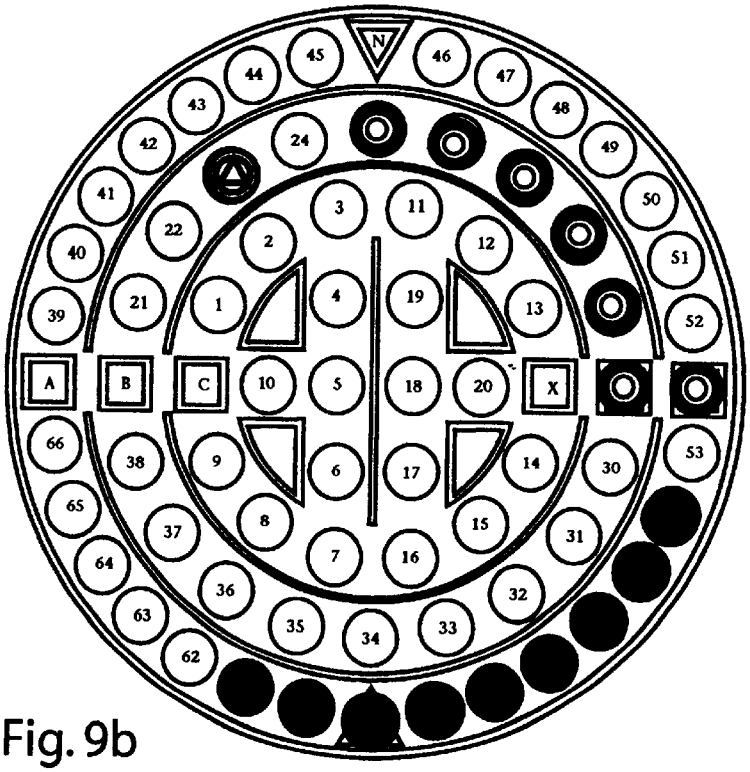

FIGS. 9*a* and 9*b* illustrate an example of moving through the gates 123, 133, 143, A, B, C, X, Y, Z.

In FIG. 9*a*, the white player is preparing to move the Squire 25 in position 24 through the gate Y.

In FIG. 9*b*, the white Squire 25 in position 24 has jumped over the white Squires 25 in positions 25, 26, 27, 28, 29, and Y and has landed in the gate Z. It is noted that FIGS. 9*a* and 9*b* illustrate the gray player performing the pivot move illustrated in FIGS. 8*a* and 8*b*.

Figure 10A:
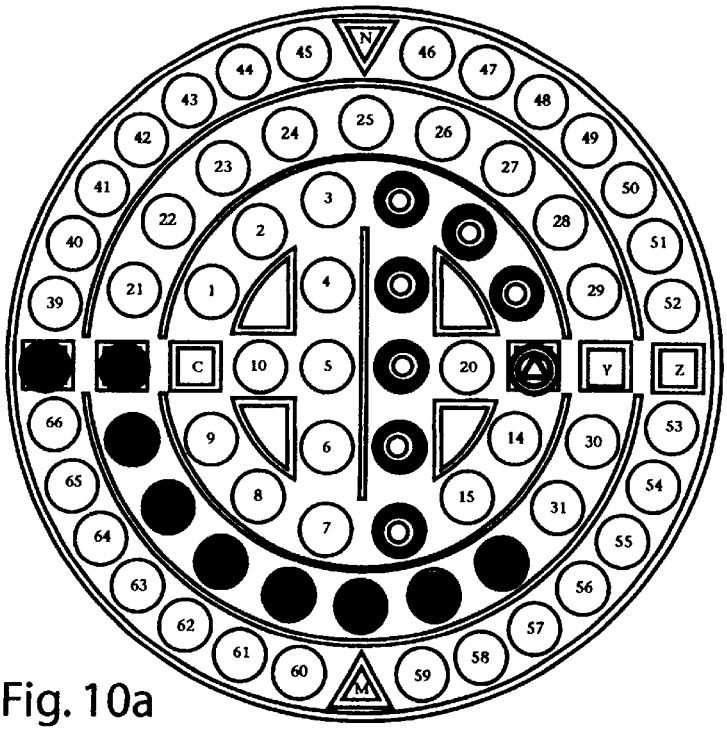
FIGS. 10*a* and 10*b* are plan views of the game board of FIG. 1 illustrating a pivot move through a gate.
Figure 10B:
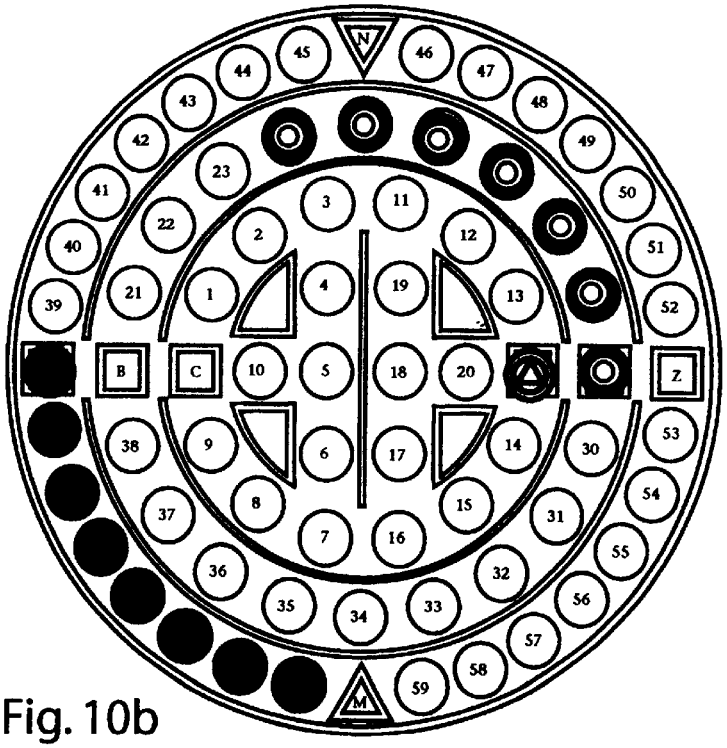

FIGS. 10*a* and 10*b* illustrate an example of pivoting through a gate.

In FIG. 10*a*, the gray player is preparing to pivot its Squires 25 in positions B, 38, 37, 36, 35, 34, 33, and 32 around the gray Royal 27 in position A through the gate A and through the gate B. FIG. 10*a* also illustrates the white player preparing to pivot its Squires 25 in positions 13, 12, 11, 19, 18, 17, and 16 about its Royal 27, located in gate X, through and past gate X.

FIG. 10*b* illustrates the end result of the gray player pivot move through and past gates A, B and the end result of the white player pivot move through and past gate X. It is noted that the Squires 25 of the white player are not able to exit through gate Y into outer ring 121 for two possible reasons. First, it is possible that white player has not ever exited the middle path 131 and, therefore, the white Squires 25 must exit the middle path 131 from gate B. Alternatively, if the white player is able to exit the middle path 131 from gate Y, then the white player was unable to rake such an exit because it did not have a piece 25, 26, 27 in gate X and gate Y.

Figure 11A:
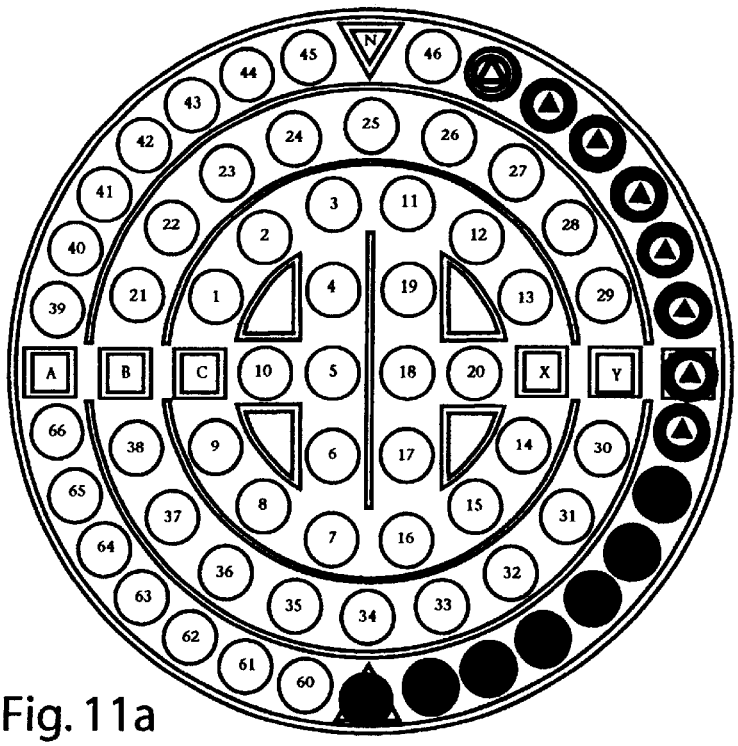
FIGS. 11*a*, 11*b*, and 11*c* are plan views of the game board of FIG. 1 illustrating various attack moves.
Figure 11B:
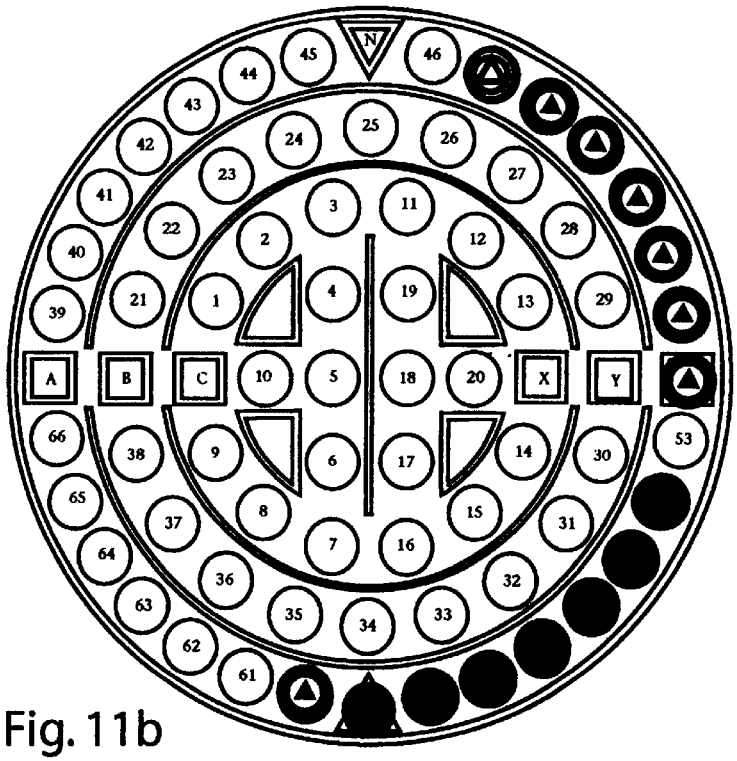
Figure 11C:
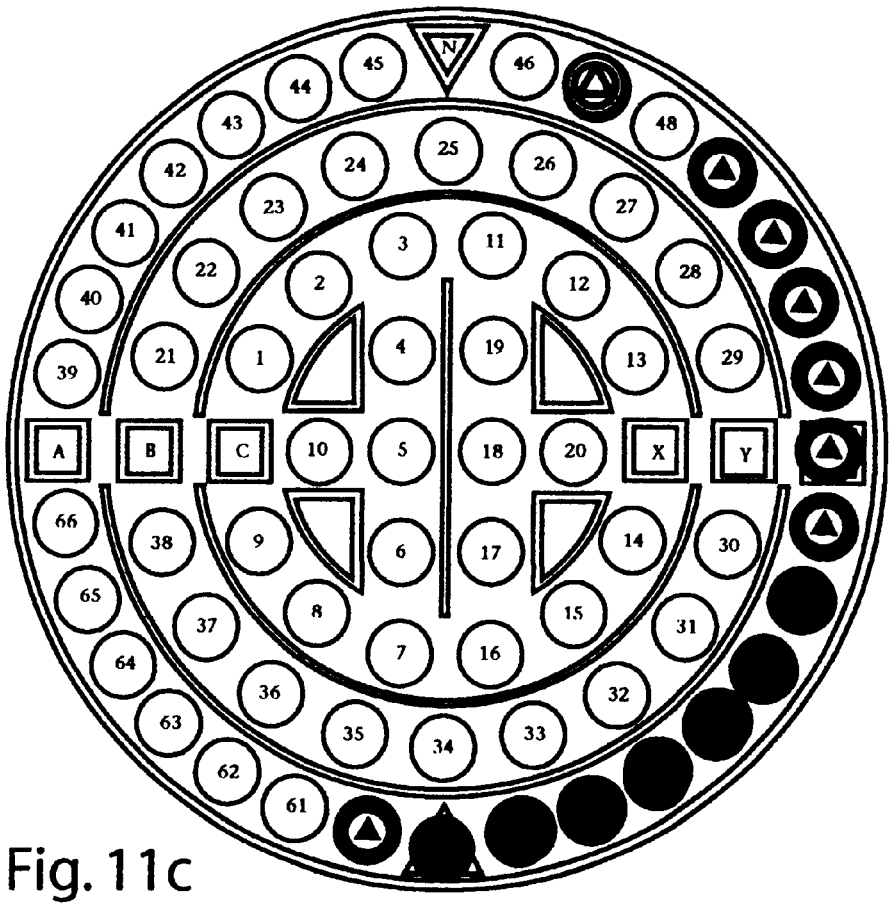

FIGS. 11*a*, 11*b*, and 11*c* illustrate examples of moves to attack a Royal 27.

In FIG. 11*a*, the white Knight 26 in position 53 is preparing to jump over all of the gray player's Knights 26 in positions 54, 55, 56, 57, 57, 58, and 59 and the gray Royal 27 in position M.

In FIG. 11*b*, the white Knight 26 lands in open position 60. Because the white player has jumped over another player's piece, the white player is required to take another turn.

In FIG. 11*c*, the white player has taken another turn by moving its Knight 26 in position 48 over its other Knights 26 in positions 49, 50, 51, 52, and Z to open position 53. Thus, putting the gray Royal 27 under attack again. It is noted that the gray Royal 27 cannot make a move in its present position. Therefore, the gray player must move its Knights 26 to get the gray Royal 27 out of attack.

FIGS. 12*a* to 12*f* illustrate an example of capturing a Royal 27.

Figure 12A:
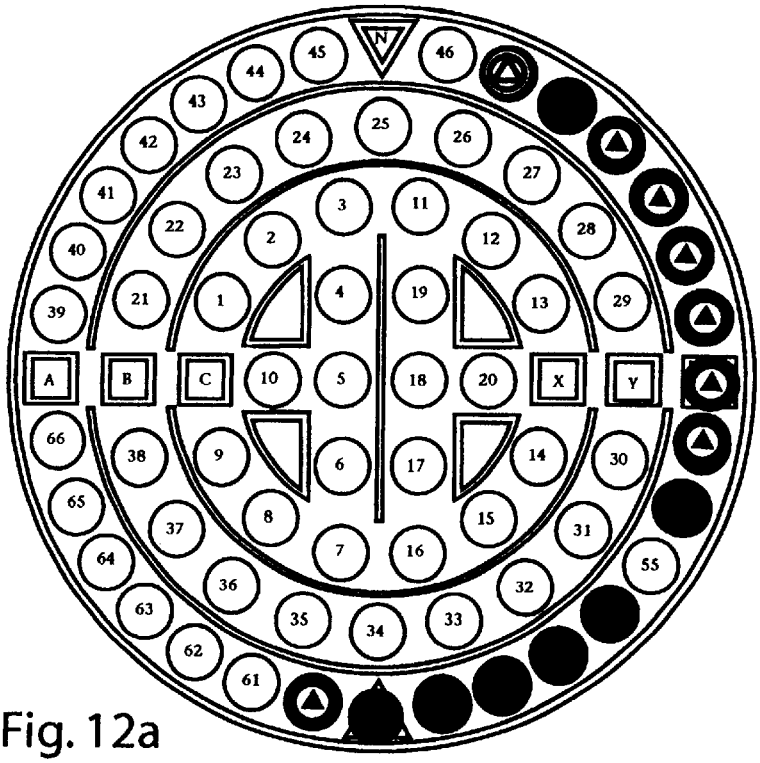
FIGS. 12*a* through 12*f* are plan views of the game board of FIG. 1 illustrating capture of a Royal.

In FIG. 12*a*, the white Knight 26 in position 53 is preparing to jump over the gray Knight 26 in position 54.

Figure 12B:
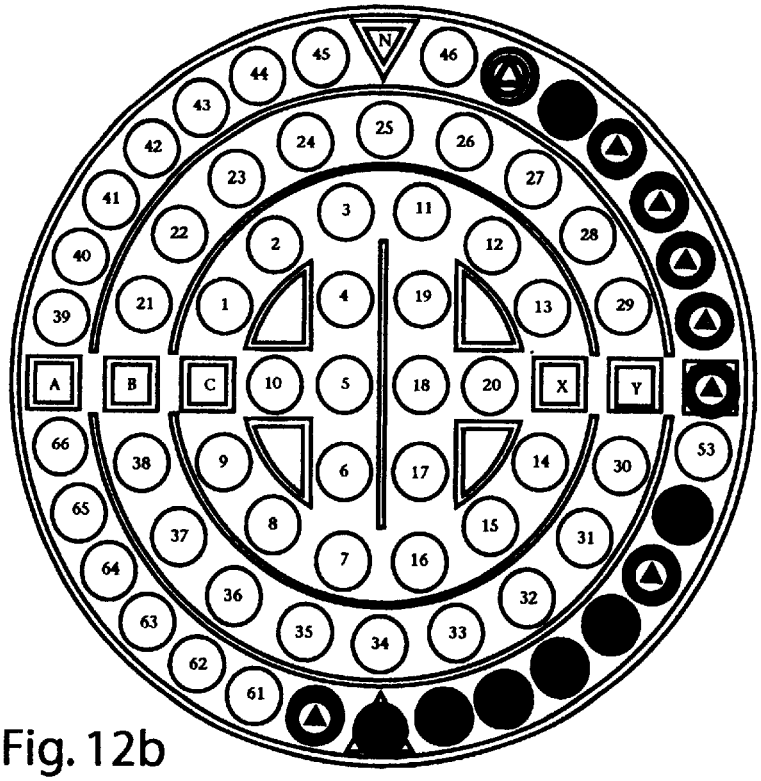

In FIG. 12*b*, the Knight 26 has landed in open position 55. The white player having jumped over another player's piece is, therefore, required to take another turn. In its second turn, the white Knight 26 in position 49 prepares to jump over the white Knights 26 in positions 50, 51, 52, and Z.

Figure 12C:
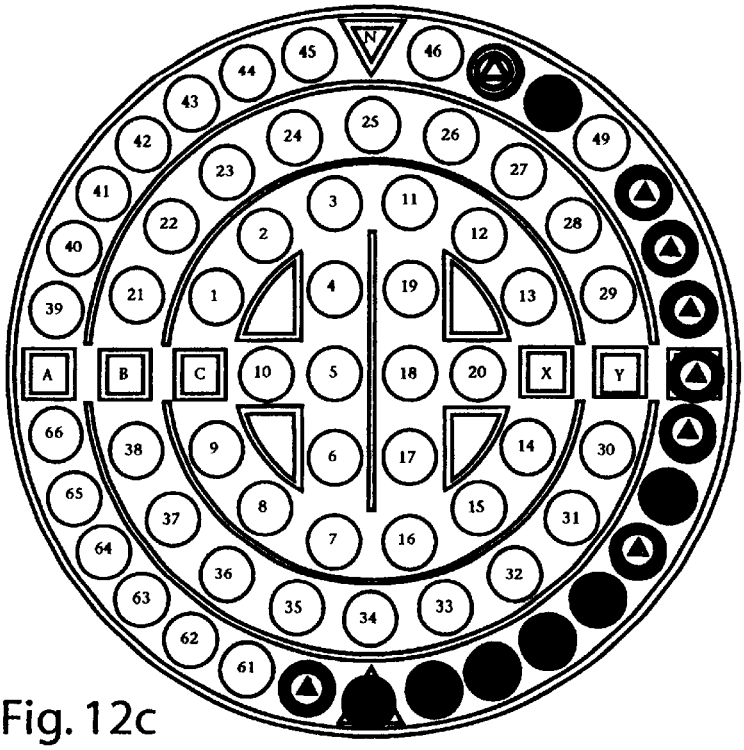

In FIG. 12*c*, the white Knight 26 has landed in open position 53. The white player's turn is now over.

Figure 12D:
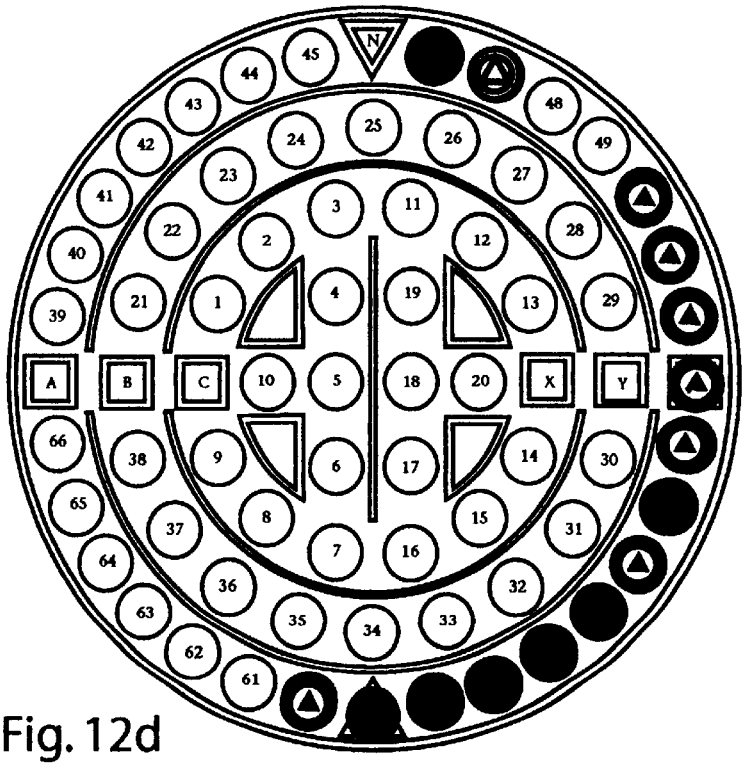

From FIGS. 12*c* to 12*d*, the gray Knight 26 in position 48 jumps over the white Royal 27 located in position 47. Because of the end placement of the gray Knight 26 in position 46, the white Royal 27 can no longer move counterclockwise in outer path 121. The gray player is required to take another turn because it has jumped over another player's piece.

Accordingly, in FIG. 12*d*, the gray player in position 54 prepares to jump over the white Knights 26 in positions 53, Z, 52, 51, and 50.

Figure 12E:
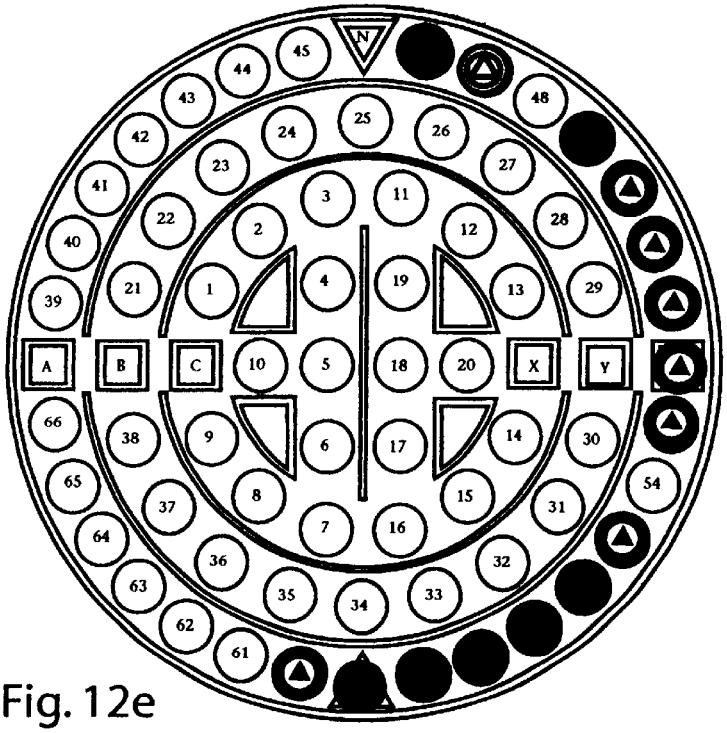
Figure 12F:
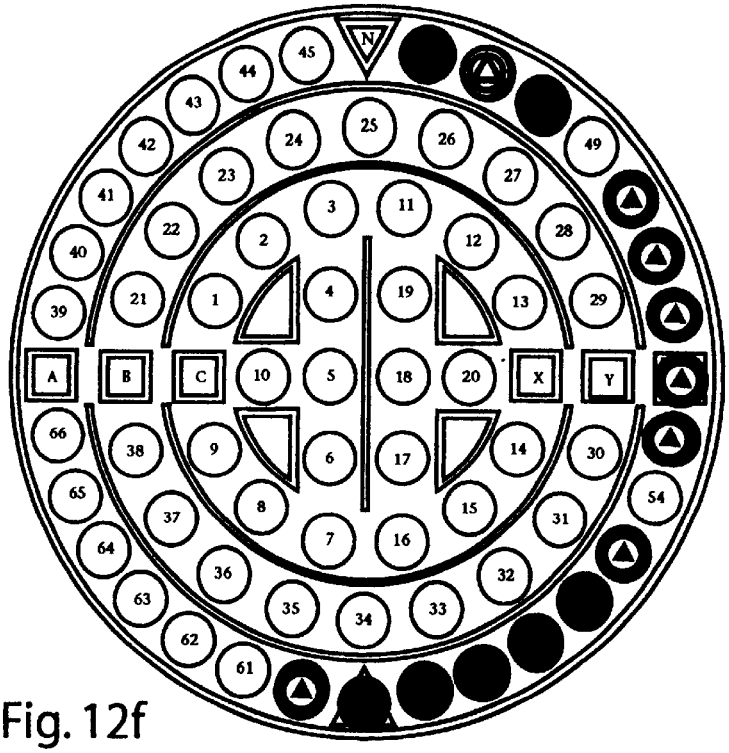

FIG. 12*e* illustrates the gray Knight landing in open position 49. The gray player is now required to take a third turn for having jumped over another player's piece. The gray Knight 26 in position 49, therefore, moves, as shown in FIG. 12*f* to open position 48. Having successfully eliminating all moves for the white Royal 27 in position 47 to make, the gray player wins.

Figure 13A:
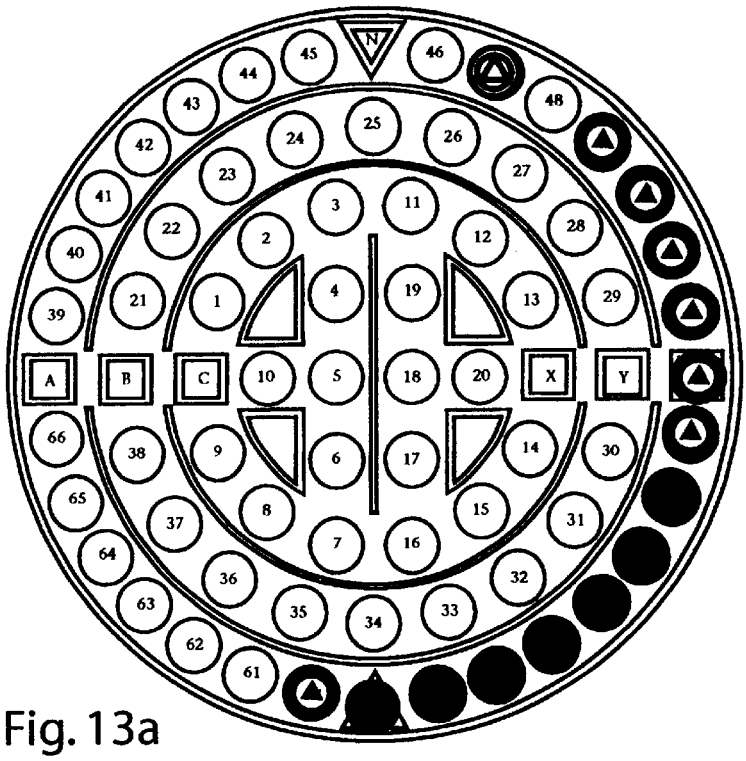
FIGS. 13*a*, 13*b*, and 13*c* are plan views of the game board of FIG. 1 illustrating avoidance of attack.
Figure 13B:
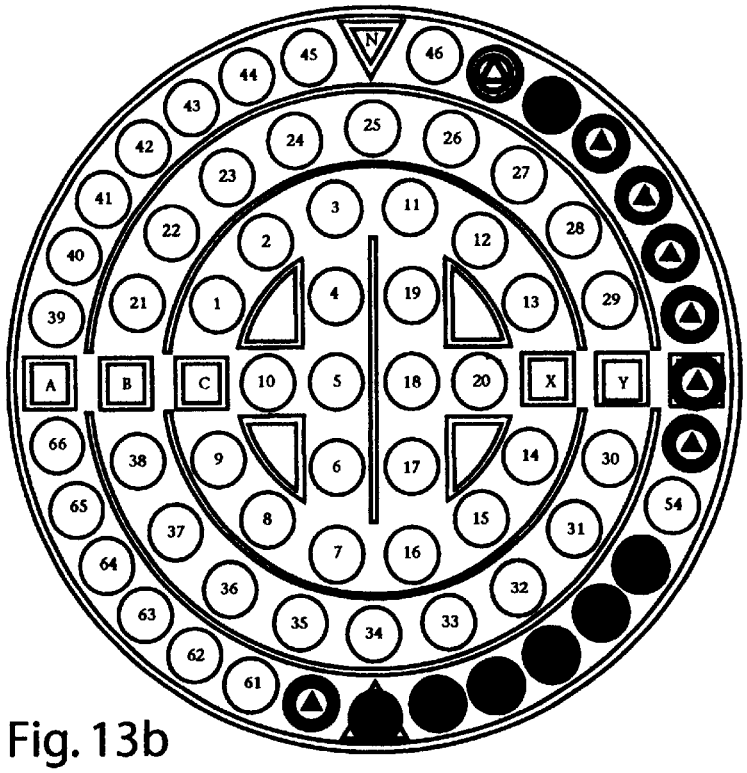
Figure 13C:
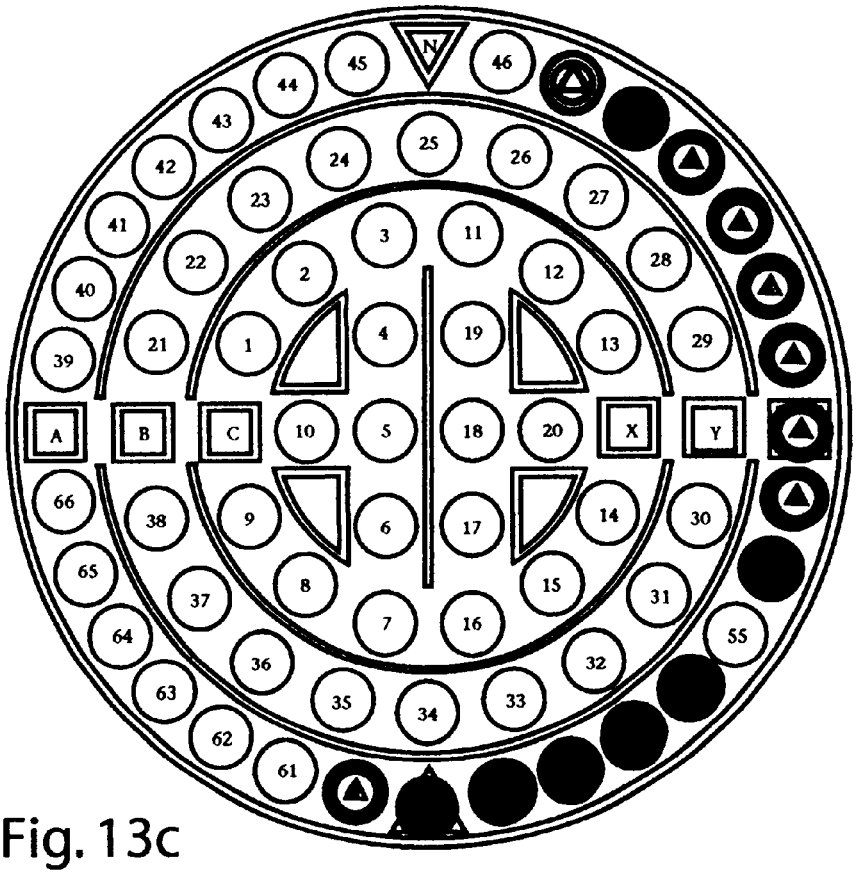

FIGS. 13*a* to 13*c* illustrate a player getting out of attack.

In FIG. 13*a*, the gray Knight 26 in position 54 prepares to jump over the white Knights 26 in positions 53, Z, 52, 51, 50 and 49.

In FIG. 13*b*, the gray Knight 26 has landed in open position 48. The gray player is now required to take another turn for having jumped over another player's piece.

In FIG. 13*c*, the gray player moves its Knight 25 in position 55 into open position 54. As such, the gray Royal 27 in position M is out of attack because the gray Royal 27 in position M is able to make a move by jumping over the gray Knights 26 in positions 59, 58, 57, and 56 to open position 55.

FIGS. 14*a* to 14*d* illustrate a player going linear, in other words, connecting its pieces into a continuous line.

Figure 14A:
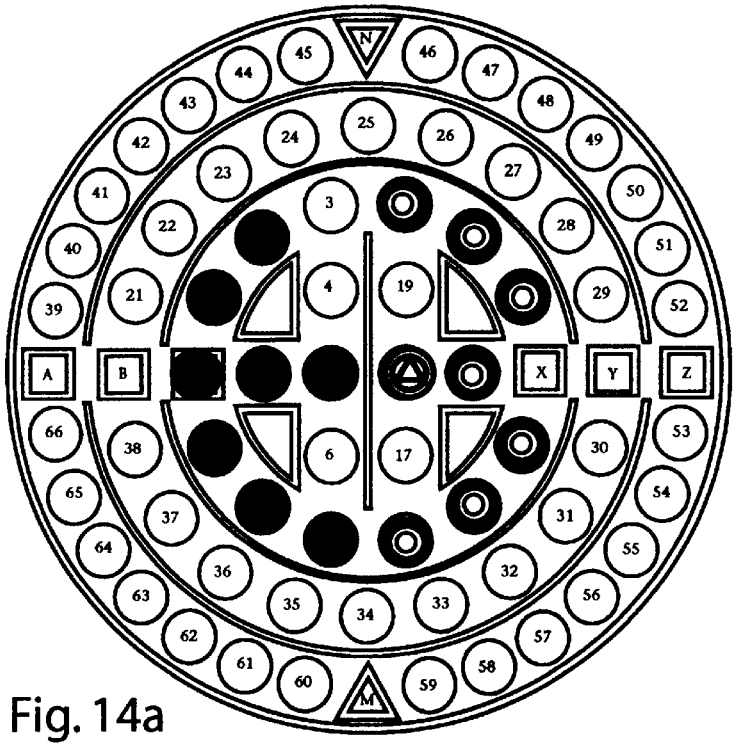
FIGS. 14*a* through 14*d* are plan views of the game board of FIG. 1 illustrating a linear connection of pieces.
Figure 14B:
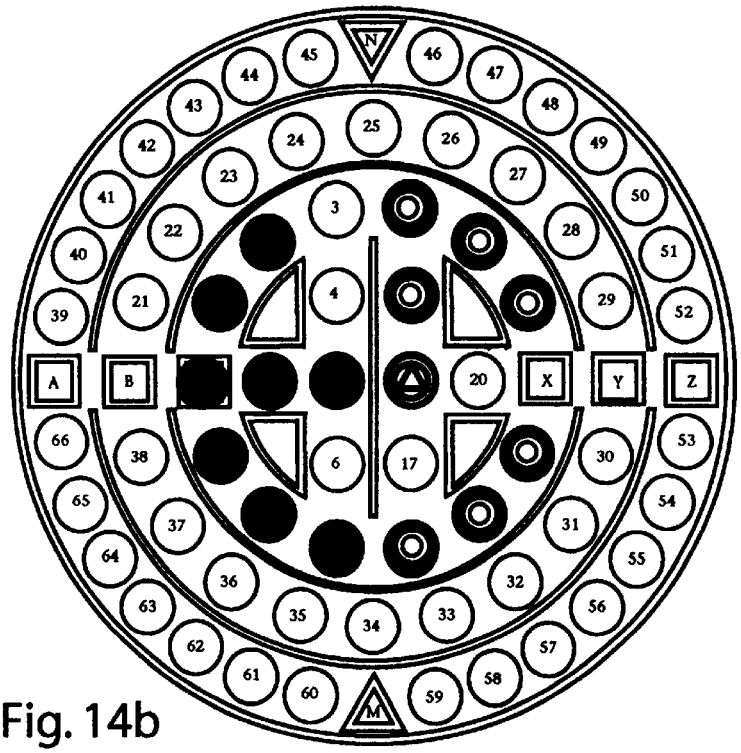

In FIGS. 14*a* and 14*b*, the white Squire 25 in position 20 pivots around the white Royal 27 in position 18 to open position 19.

Figure 14C:
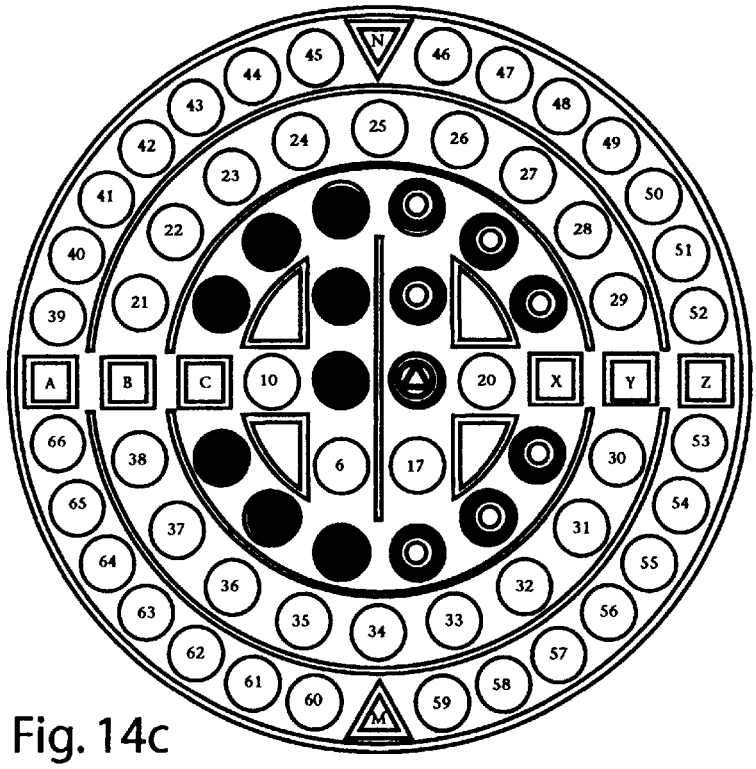

In FIGS. 14*b* to 14*c*, the gray Squires 25 in positions 10 and C pivot around the gray Royal 27 in position 5 and land in open positions 4 and 3.

Figure 14D:
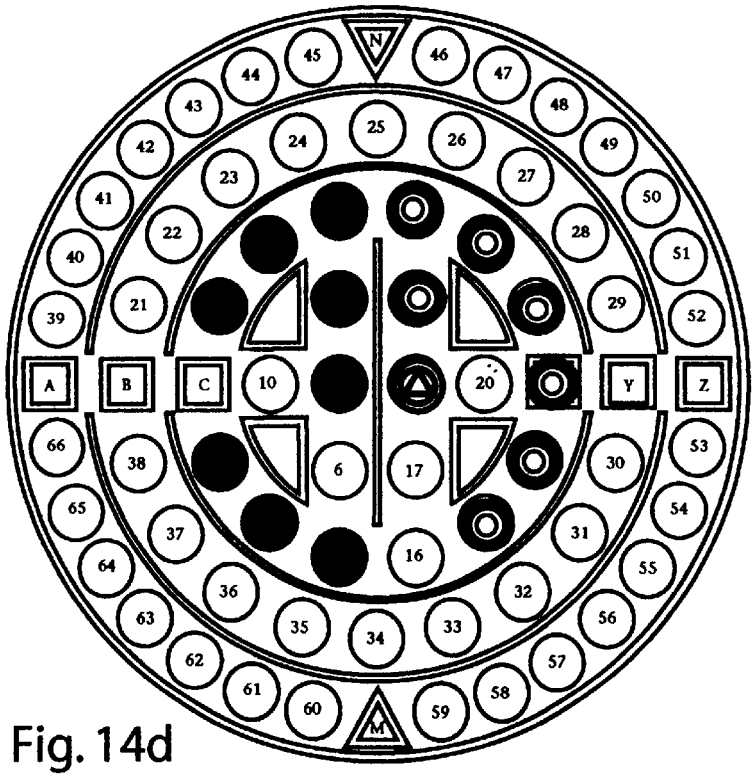

In FIGS. 14*c* to 14*d*, the white Squire 25 in position 16 jumps over white Squires 25 in positions 15 and 14 and lands in open gate X. The white player is now linear. It is noted that the gray player can go linear by jumping the gray Squire 25 in position 7 over gray Squires 25 in positions 8 and 9 to land in open gate C.

FIGS. 15*a*, 15*b*, 16*a*, 16*b*, 17*a*, 17*b*, 18*a*, and 18*b* illustrate various illegal moves.

Figure 15A:
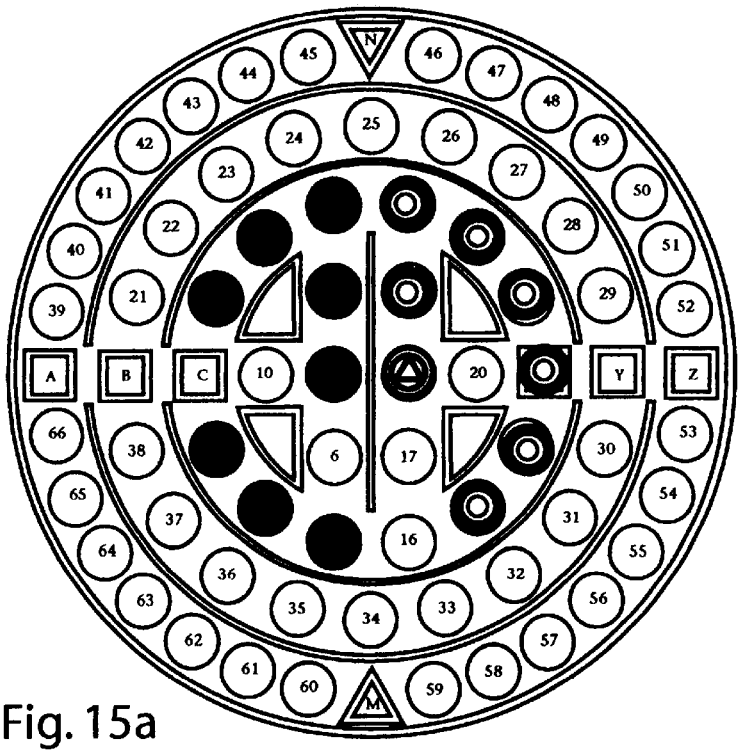
FIGS. 15*a*, 15*b*, 16*a*, 16*b*, 17*a*, 17*b*, 18*a*, and 18*b* are plan views of the game board of FIG. 1 illustrating various illegal
Figure 15B:
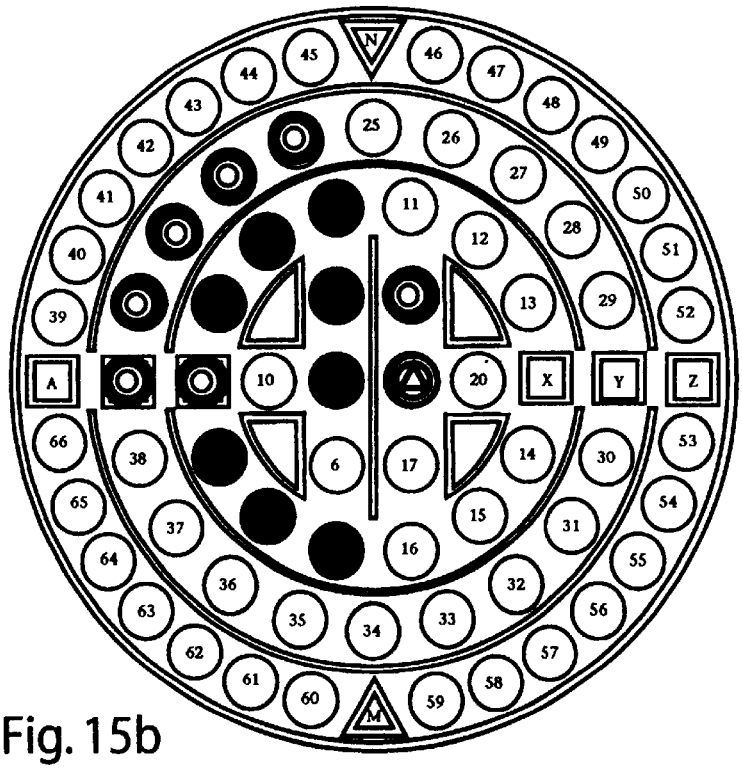

In FIGS. 15*a* and 15*b*, the white Squires 25 attempt to jump from positions 11, 12, 13, X, 14, and 15 over gray Squires 25 in positions 3, 2, and 1. This is an illegal move because, even though the white Squires 25 overpowered the gray Squires 25 in the jump, the white Squires 25 landing in open gates C and B and open positions 21, 22, 23, and 24 did not observe rules relating to the gates 123, 133, 143, to wit, the gate C was not occupied by a piece 25, 26, 27. To make this move legal, for example, a gray Squire 25 would need to be in gate C.

Figure 16A:
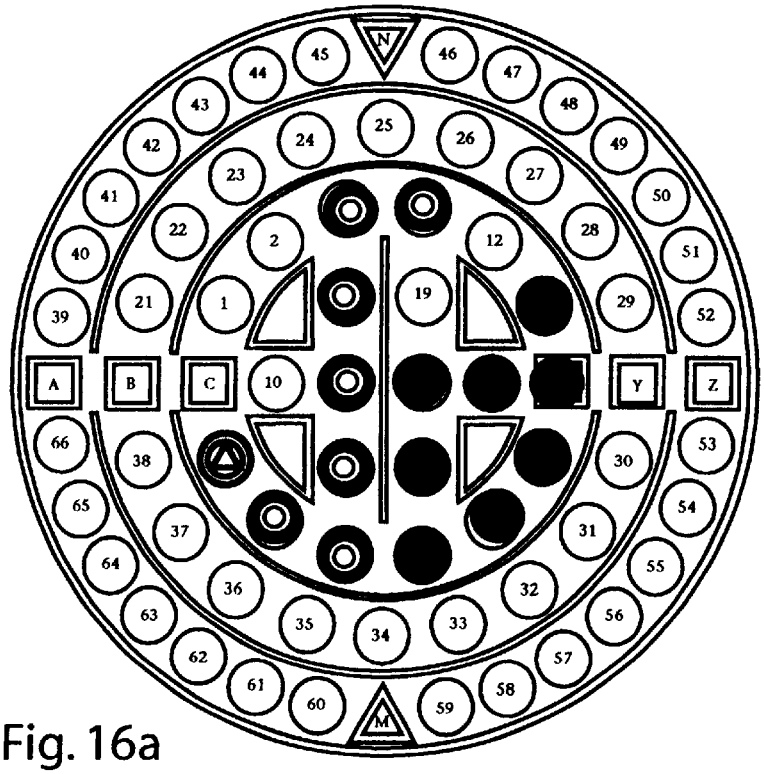
Figure 16B:
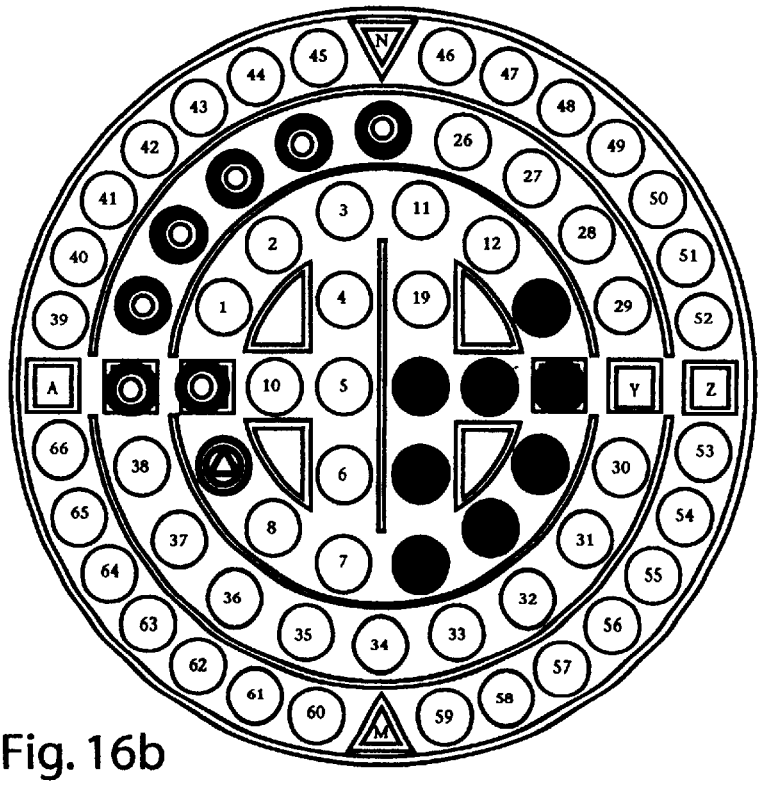

In FIGS. 16*a* and 16*b*, the white Squires 25 attempt to pivot from positions 8, 7, 6, 5, 4, 3, and 11 around the white Royal 27 in position 9. This is an illegal move because the white Squires landing in open gates C and B and open positions 21, 22, 23, 24 and 25 did not observe rules relating to the gates 123, 133, 143. To make this move legal the white Royal 27 would need to be in gate C with all white Squires 25 linear.

Figure 17A:
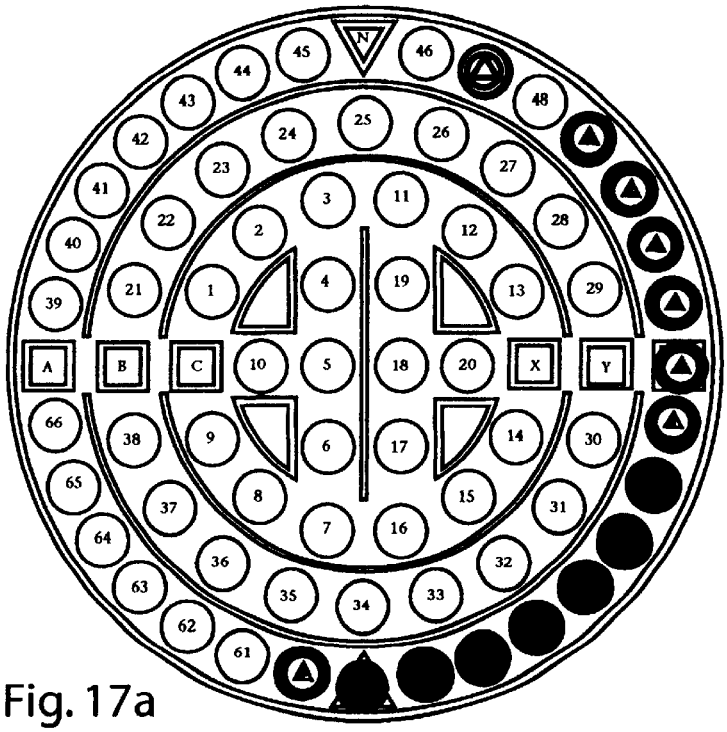
Figure 17B:
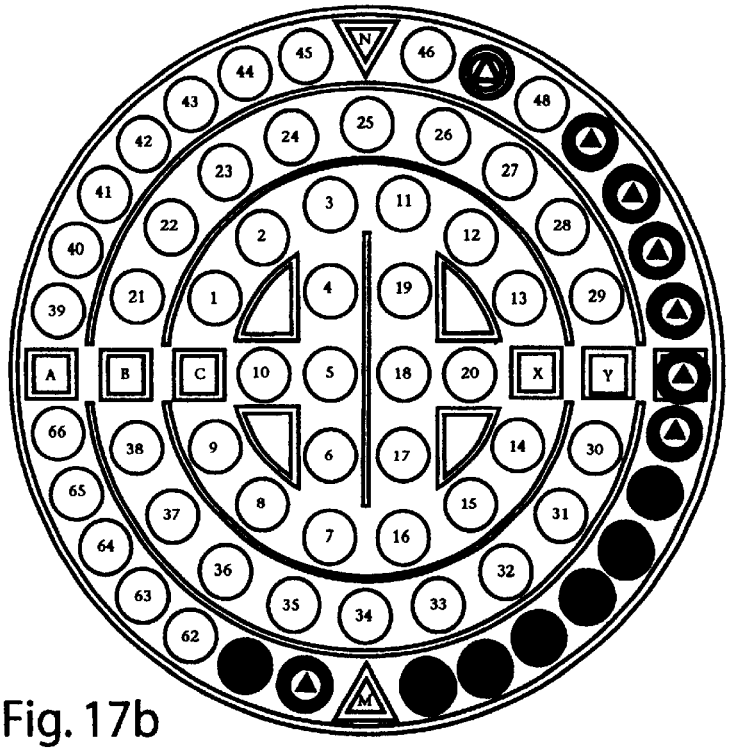

In FIGS. 17*a* and 17*b*, the gray Royal 27 in position M attempts to escape attack by jumping over the white Knight 26 in position 60 to land in open position 61. This is an illegal move because a Royal 27 may never jump an opponent's Knight 26. To make this move legal, the piece in position 60 must be a white Squire 25 or a white Royal 27.

Figure 18A:
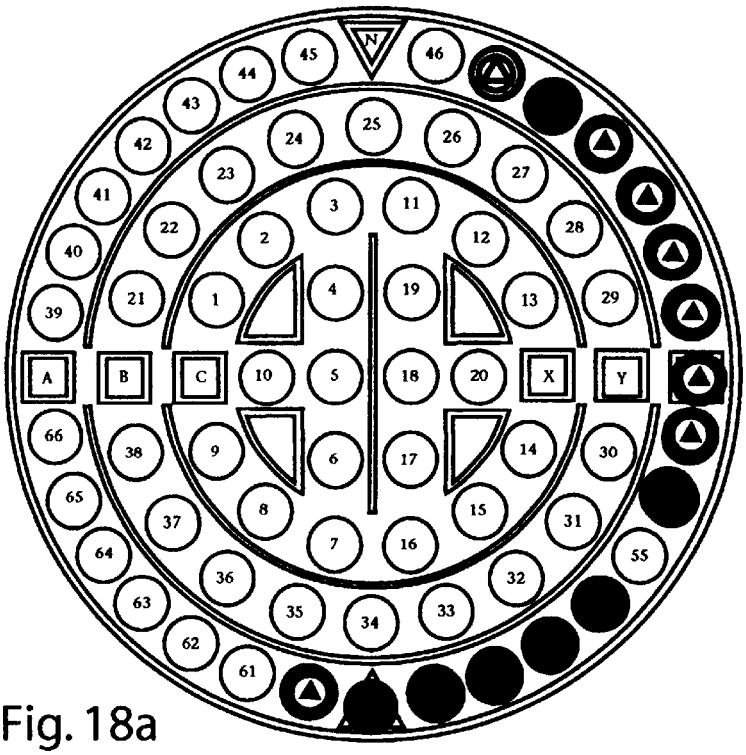
Figure 18B:
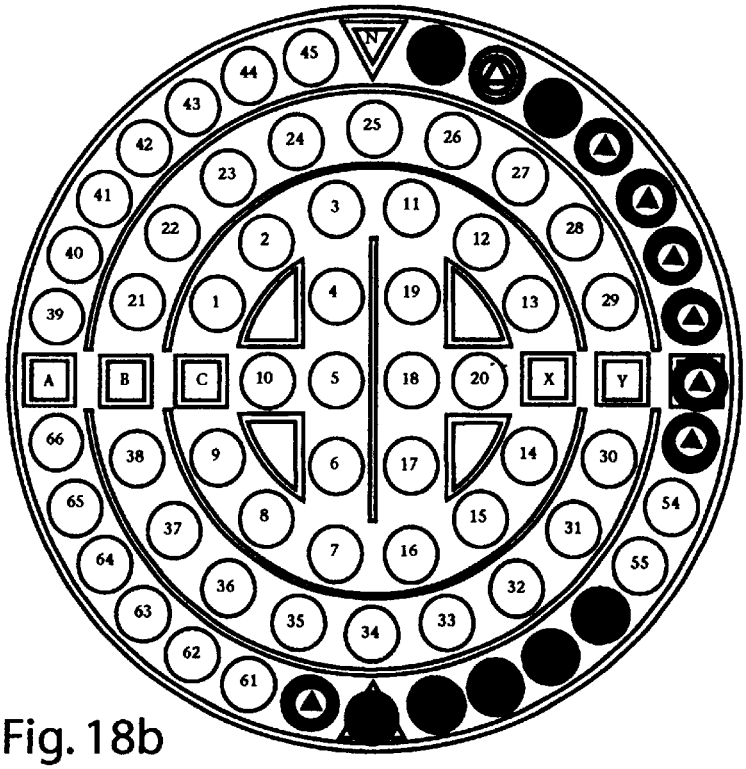

In FIGS. 18*a* and 18*b*, the gray Knight 26 attempts to jump over the white Knights 26 in positions 53, Z, 52 51, 50, and 49, and the gray Knight 26 in position 48, and the white Royal 28 in position 47 to land in open position 46. This move is illegal because the player did not observe the rules relating to mixed-player jumping. A player may never jump over mixed players in the same move. To make this move legal, the piece in position 48 would need to be a white piece.

The above description provides a unique, concentrically shaped board game entirely different from checkers. In significant contrast thereto, the game according to the invention does not eliminate opponent's pieces to win. Such a game, therefore, requires a greater level of skill than checkers and requires a player to make complicated decisions and anticipate future moves, much like the game of chess, but with different kinds of pieces and with a different playing surface.

I claim:

1. A method of playing a game, which comprises:

providing a game board having a game surface with defined playing piece locations;

defining at least two of the piece locations as converting locations;

providing a set of playing pieces to at least two opposing players, each playing piece set having:

only one first piece; and a subset of second pieces identical to one another and different from the first piece;

placing each of the playing piece sets on the piece locations of the game surface;

initially defining the second piece subset as having a first set of characteristics;

defining respective pieces of the second piece subset as having a second set of characteristics when the respective pieces are placed on or jump over one of the converting locations; and each of the players taking turns to move their own playing pieces among the piece locations and prevent the first piece of another one of the players from being able to move from one of the piece locations to another of the piece locations.

2. The method according to claim 1, wherein none of the playing pieces are eliminated throughout the game.

3. The method according to claim 1, which further comprises eliminating none of the playing pieces during the game.

4. The method according to claim 1, which further comprises keeping constant a total number of playing pieces on the game surface throughout the entire game.

5. The method according to claim 1, wherein the second set of characteristics includes characteristics different from characteristics of the first set of characteristics.

6. The method according to claim 1, wherein the second set of characteristics includes characteristics in addition to characteristics of the first set of characteristics.

7. The method according to claim 1, which further comprises organizing the playing piece locations of the game surface in concentric circles.

* * * * *